US006742996B2

(12) United States Patent
Ueda et al.

(10) Patent No.: US 6,742,996 B2
(45) Date of Patent: Jun. 1, 2004

(54) SCROLL COMPRESSOR WITH MECHANICALLY ACTUATED CAPACITY CONTROL

(75) Inventors: Motohiko Ueda, Okazaki (JP); Shigeru Hisanaga, Kariya (JP); Takashi Inoue, Okazaki (JP); Mikio Matsuda, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/015,910

(22) Filed: Dec. 17, 2001

(65) Prior Publication Data

US 2002/0081224 A1 Jun. 27, 2002

(30) Foreign Application Priority Data

Dec. 22, 2000 (JP) ..... 2000-391245

(51) Int. Cl.[7] ..... F04B 49/00; F01C 1/02
(52) U.S. Cl. ..... 417/310; 418/55.5
(58) Field of Search ..... 417/274, 410.5, 417/310; 418/55.5, 16, 29

(56) References Cited

U.S. PATENT DOCUMENTS 5,040,958 A * 8/1991 Arata et al. ..... 418/55.5
5,193,987 A 3/1993 Iio et al.
5,224,849 A * 7/1993 Forni ..... 418/55.5
5,336,058 A 8/1994 Yokoyama
5,366,359 A * 11/1994 Bookbinder et al. ..... 418/55.5
5,451,146 A * 9/1995 Inagaki et al. ..... 417/310
5,490,769 A * 2/1996 Calhoun ..... 418/1
6,086,335 A * 7/2000 Bass et al. ..... 417/220
6,341,945 B1 * 1/2002 Hugenroth et al. ..... 417/214

FOREIGN PATENT DOCUMENTS

| | | | | |
|---|---|---|---|---|
| EP | 0 747 597 A2 | | 12/1996 | |
| JP | A-61-46485 | | 3/1986 | |
| JP | 61-46485 | * | 3/1986 | ..... F04C/18/02 |
| JP | A-2-252990 | | 10/1990 | |
| JP | A-4-179887 | | 6/1992 | |
| JP | A-5-231353 | | 9/1993 | |
| JP | A-7-293466 | | 11/1995 | |
| JP | A-9-195957 | | 7/1997 | |

* cited by examiner

*Primary Examiner*—Justine Yu
*Assistant Examiner*—Timothy P. Solak
(74) *Attorney, Agent, or Firm*—Posz & Bethards, PLC

(57) ABSTRACT

A scroll-type compressor for realizing the operating condition of complete 0% capacity without using an electromagnetic clutch. In order to minimize the power loss, a compliance crankshaft mechanism for allowing the orbiting radius of the movable scroll member to change steplessly to zero is interposed between a shaft and a scroll member. A guide hole having an inclined surface such as a two-step conical surface is formed at the end plate of the movable scroll member. A plunger adapted to engage by advancing toward and retracting from the guide hole is supported on a housing. When the plunger is advanced into the guide hole under the control of a control operation device including a control pressure chamber and a control valve, the movable scroll member moves radially, so that the amount of eccentricity and the orbiting radius thereof are reduced to achieve the 0% capacity.

20 Claims, 21 Drawing Sheets

SCROLL COMPRESSOR WITH MECHANICALLY ACTUATED CAPACITY CONTROL

BACKGROUND OF THE INVENTION

1. Field of the Invention

The present invention relates to a displacement compressor used for compressing the refrigerant of an automotive air-conditioning system, or in particular to a scroll-type compressor.

2. Description of the Related Art

In an air-conditioning system of an automotive vehicle, for example, the need for an inexpensive, compact and lightweight refrigerant compressor and the fact that the electromagnetic clutch normally provided for transmitting or cutting off the driving force from an engine is expensive, bulky and heavy have led to the demand for a compressor of new type which requires no electromagnetic clutch. To meet this demand, a swash plate compressor has already been practically used, in which the discharge capacity can be changed from 100% to 0% by changing the inclination of the swash plate. However, a scroll-type compressor of which the discharge capacity can be reduced to 0% has yet to be realized.

For eliminating the electromagnetic clutch added to the scroll-type compressor, it is necessary that the scroll-type compressor can operate with 0% capacity to reduce the discharge capacity thereof to zero in substantially the same manner as if the electromagnetic clutch is off on the one hand and that the power loss in operation is so small as to have no adverse effect on the fuel cost of the automotive vehicle on the other.

To cope with this problem, the variable-capacity type refrigerant compressor of a scroll type described in Japanese Unexamined Patent Publication No. 5-231353 has been proposed in the prior art. In this compressor, a bypass is arranged between a compression chamber formed between a stationary scroll member and a movable scroll member and an intake chamber on the low-pressure side, and the discharge capacity is changed by opening/closing the bypass with a shuttle valve or the like. Since the compressed refrigerant cannot be fully returned to the intake chamber when the compressor is operating at high speed, however, it is difficult to achieve 0% capacity.

In what is called a combination system, having both a bypass from the compression chamber and a bypass from the discharge chamber where the compressed refrigerant is concentrated such as the scroll-type compressor described in Japanese Unexamined Patent Publication No. 4-179887, the following problem is posed. Specifically, in the operation at 0% capacity, the entire amount of the refrigerant compressed is returned from the discharge chamber to the intake chamber and the orbiting radius of the movable scroll member is constant, so that the operation of 0% capacity remains the same as with that of 100% capacity. Therefore, the friction of the sliding parts is as large for 0% capacity as for 100% capacity, and the power loss in the 0% capacity operation is increased to a not-negligible degree.

Further, in the scroll-type compressor described in Japanese Unexamined Patent Publication No. 2-252990, not only the movable scroll member is moved but also the stationary scroll member is rotated relatively to the movable scroll member, and the crankshaft radius is made variable to assure smooth contact between the movable scroll member and the stationary scroll member. The mechanism in which the stationary scroll member is rotated as well as the movable scroll member, however, poses the problem that the structure is complicated and the compressor becomes bulky as a whole.

SUMMARY OF THE INVENTION

The object of the present invention is to obviate the aforementioned problem of the prior art, using a novel means, and to provide a compact, lightweight and inexpensive scroll-type compressor in which not only the electromagnetic clutch is eliminated but also the power loss is minimized in the 0% capacity operation by realizing the complete 0% capacity operation.

According to the invention, as a means for solving the problem described above, there is provided a scroll-type compressor comprising a housing journaling a drive shaft, a stationary scroll member including an end plate fixed on the housing and a spiral blade around the center axis of the shaft, a movable scroll member including an end plate and a spiral blade forming a plurality of compression chambers by engaging the spiral blade and the end plate of the stationary scroll member, the movable scroll member being capable of orbiting around the center axis of the shaft, a compliance crankshaft mechanism interposed between the shaft and the movable scroll member for orbiting the movable scroll member by the shaft and allowing the orbiting radius of the movable scroll member to change steplessly downward substantially to zero, a guide hole formed in a selected one of the movable scroll member and the housing and having an inclined surface with the depth along the center axis of the shaft changing in a radial direction, a plunger supported on a selected one of the movable scroll member and the housing in which the guide hole is not formed and which is adapted to advance toward and retract from the guide hole to thereby assume a selected one of a position in engagement with the guide hole and a position out of engagement with the guide hole, and control operation means for controlling the plunger to advance and retract along the center axis of the shaft.

A scroll-type compressor according to the invention comprises a compliance crankshaft mechanism interposed between a shaft and a movable scroll member for allowing the orbiting radius of the movable scroll member to be reduced steplessly substantially to zero, wherein one of the movable scroll member and the housing is formed with a guide hole, wherein the guide hole has an axis and a conical surface, wherein the axis of the guide hole is parallel to the center axis of the shaft. The other one of the movable scroll member and the housing not formed with the guide hole supports a plunger adapted to move toward and away from the guide hole to select a position to engage or not to engage the guide hole. The plunger is controlled by control means to advance and retract with respect to the direction of the center axis of the shaft.

When the plunger is advanced to the bottom portion of the guide hole, the position of the forward end of the plunger engaging the inclined surface of the guide hole so changes that the engagement changes to a higher position of the inclined surface. Thus, the movable scroll member is pushed down radially, and the center of the movable scroll member approaches and finally comes to coincide with the center of the stationary scroll member. In this condition, the compression chamber formed between the spiral blade of the movable scroll member and the spiral blade of the stationary scroll member is open, and therefore the fluid like the refrigerant is not compressed. Thus, the operation capacity is reduced to 0%, and even when the shaft is in rotation, the discharge amount is reduced substantially to zero. Under this operating condition, the compressor substantially fails to work, and therefore the power consumption is reduced substantially to zero even when the shaft is in rotation. Thus, the same condition is developed as if the electromagnetic clutch is deenergized.

In another embodiment, a guide hole can alternatively be formed in the end plate of the movable scroll member, and the plunger is supported by the housing. Conversely, a guide hole may be formed in the plunger adapted to move by being supported on the housing, and a pin engaging the guide hole may be arranged on the end plate of the movable scroll member as another alternative. As still another alternative, a guide hole is formed in the eccentric bushing of the compliance crankshaft mechanism supporting the end plate of the movable scroll member, while at the same time supporting the plunger on the shaft journaled by the housing.

A guide hole configured of a two-stepped conical surface can be reduced in depth. In the case where the guide hole is formed of a curved surface such as a quadratic surface of revolution, on the other hand, the same effect can be achieved smoothly as the two-stepped conical surface. Provision of energization means such as a spring for retreating the plunger completely from the position of engagement with the guide hole can always realize the operation of 100% capacity. Nevertheless, the configuration can be simplified by omitting the energization means. Also, if the edge portion of the guide hole opening is formed with a cylindrical surface, on the other hand, the rotation of the movable scroll member can be prevented by use of the guide hole, and therefore the need of an antirotation mechanism is eliminated.

One or several plungers may be provided. In the case where a single annular plunger is arranged in such a position as to surround the centerline of the shaft, the axial force can be generated against the guide hole uniformly around the shaft. Thus, the movable scroll member can be smoothly operated in radial direction, thereby making it possible to prevent vibration or the like.

If a counter weight is mounted radially movably on the shaft with a bifacial portion, while the movable scroll member is moved radially in such a manner as to reduce the discharge capacity to zero, the counter weight that has thus far been in contact with the outer periphery of an eccentric bushing constituting a part of the compliance crankshaft mechanism comes into contact with the outer periphery of a large-diameter boss portion constituting a part of the shaft while leaving the outer periphery of the eccentric bushing from a predetermined time point. By configuring in this way, an excessively large pressure is prevented from being imparted between a pair of the spiral blades forming the compression chamber by the large centrifugal force exerted on the movable scroll member under a heavy-load, high-speed operating condition. In this way, the wear of the spiral blades can be suppressed.

Further, in the case where a bypass adapted to establish communication between the compression chamber of intermediate pressure in the process of compression and the lower pressure side is opened to the end plate of the stationary scroll member and control means is provided for opening/closing the bypass, the compression chamber of intermediate pressure communicates with the low-pressure side when the bypass is opened by the control means. As a result, the discharge capacity is reduced, so that an intermediate discharge capacity between 100% and 0% can be achieved in stable fashion. In this way, the discharge capacity can be selectively controlled in three stages very easily.

As described above, with the scroll-type compressor according to this invention, the operation of 0% capacity with a very small power loss can be realized by reducing the orbiting radius of the movable scroll member to zero. Therefore, a scroll-type compressor with a variable discharge capacity free of the electromagnetic clutch can be provided.

DESCRIPTION OF THE PREFERRED EMBODIMENTS

Figure 1:
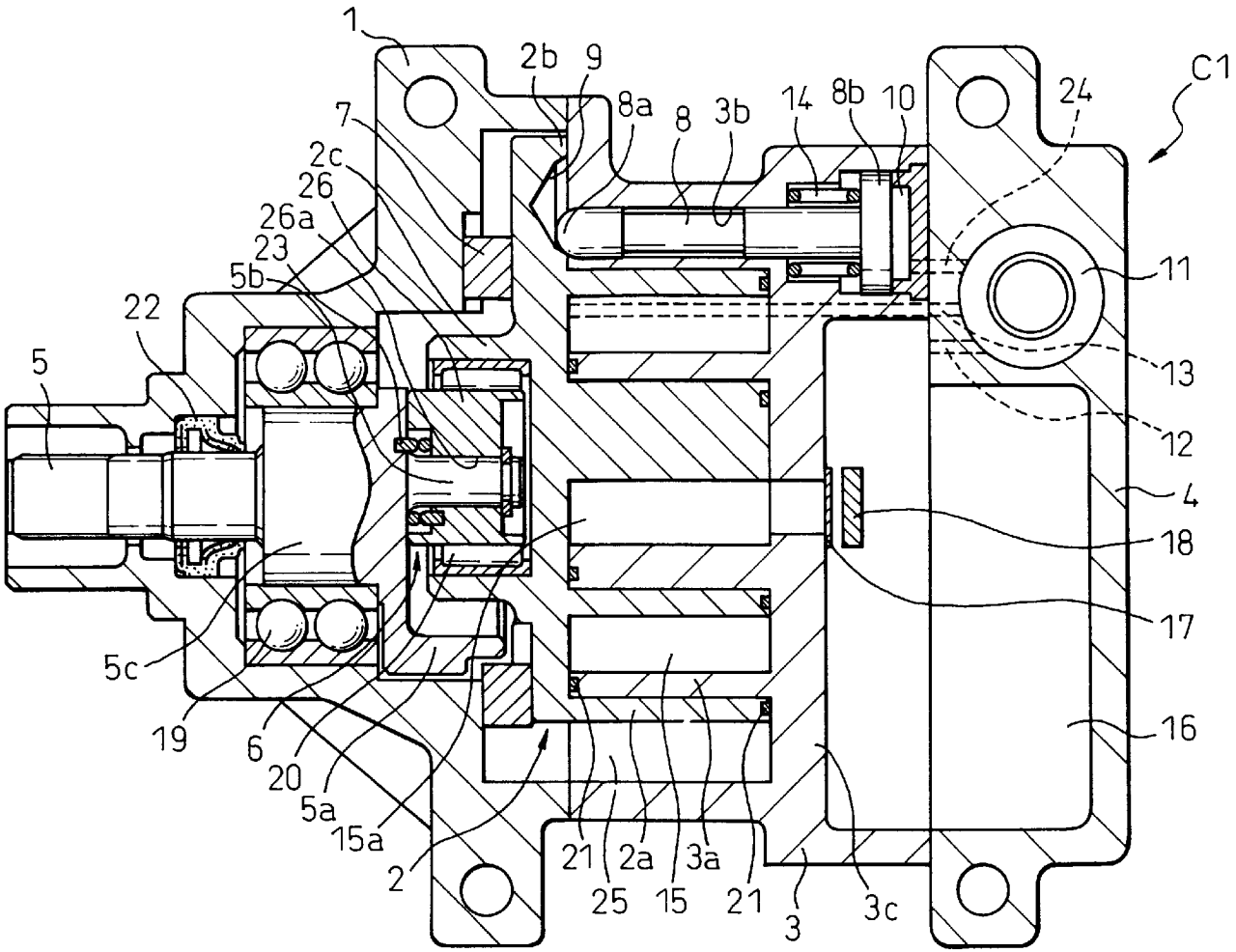
FIG. 1 is a longitudinal front view of a compressor operating at 100% capacity according to a first embodiment of the invention.
Figure 2:
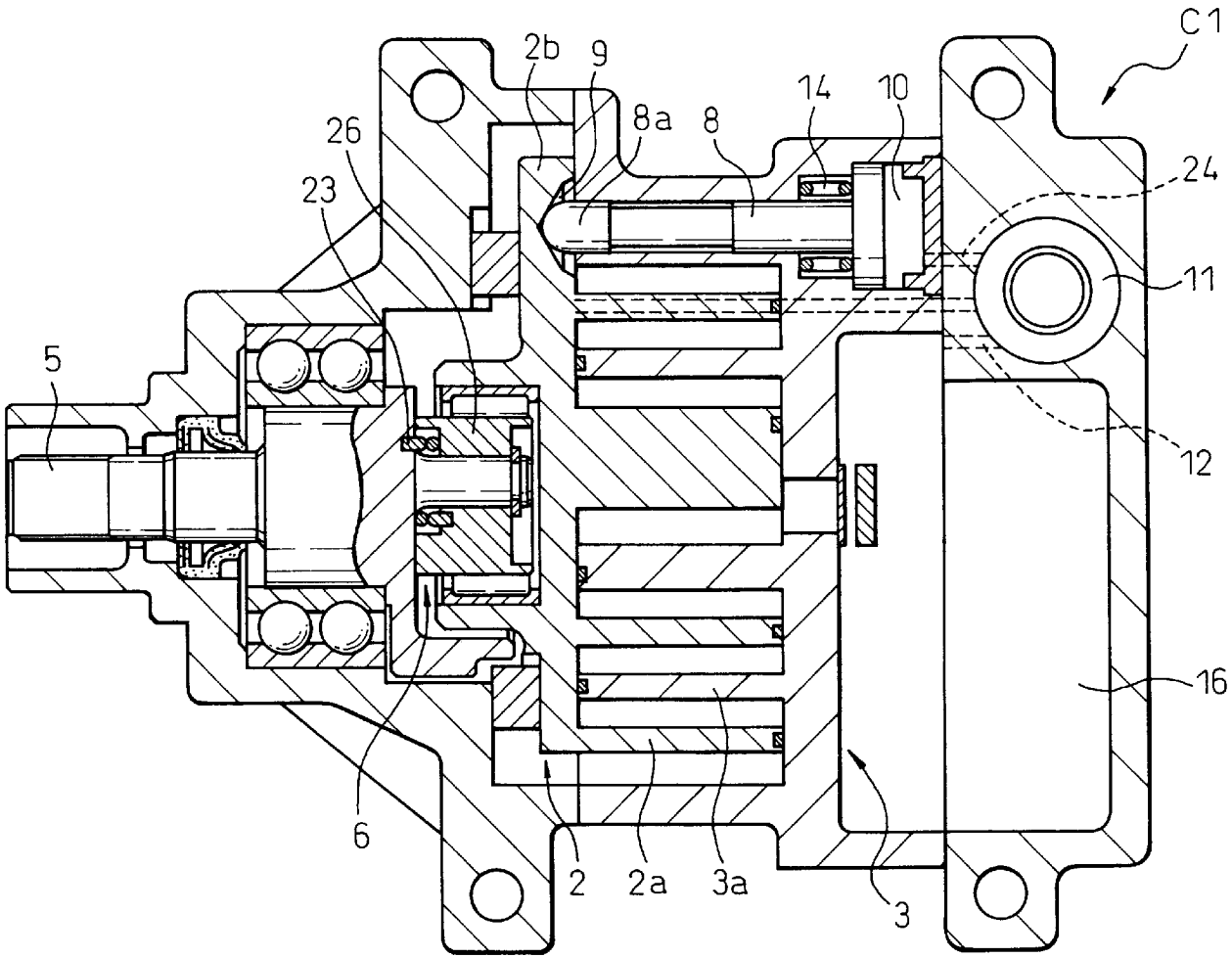
FIG. 2 is a longitudinal front view of a compressor operating at 0% capacity according to a first embodiment of the invention.

FIGS. 1 and 2 show a general configuration of a scroll-type compressor Cl according to a first embodiment of the invention. FIG. 1 shows the compressor operating at 100% capacity, and FIG. 2 shows the compressor operating at 0% capacity. In FIGS. 1 and 2, reference numeral 1 designates a front housing, numeral 2 a movable scroll member orbitably supported in the housing, numeral 3 a stationary scroll member constituting a part of the housing, and numeral 4 a rear housing. The front housing 1, the stationary scroll member 2 and the rear housing 4 are integrated by coupling means such as a through bolt, not shown, and constitute a single housing. Numeral 5 designates a drive shaft rotatably supported in the front housing 1. A part of the shaft 5 is formed integrally with a counter weight 5*a* for suppressing the unbalanced vibrations caused by the orbital motion of the movable scroll member 2.

Figure 3:
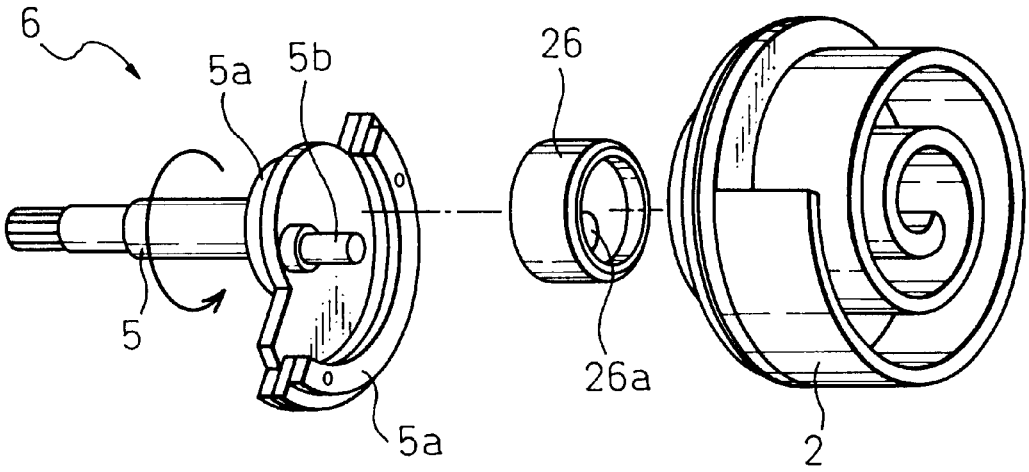
FIG. 3 is an exploded perspective view illustrating the structure of a compliance crankshaft mechanism.

Numeral 6 designates what is called a compliance crankshaft mechanism, which supports the movable scroll member 2 orbitably while allowing the amount of eccentricity of the center of the movable scroll member 2 with respect to the shaft 5, i.e. the orbiting radius of the movable scroll member 2 to change continuously. An example of the structure of this compliance crankshaft mechanism is shown in the perspective view of FIG. 3 as well as FIGS. 1 and 2. The boss portion 5*c* of the shaft 5 where the counter weight 5*a* is mounted is formed integrally with an eccentric pin 5*b* extending along the axis in a position eccentric with respect to the shaft 5, which eccentric pin 5*b* is rotatably inserted into the eccentric hole 26*a* formed eccentrically in the cylindrical eccentric bushing 26. The eccentric bushing 26 rotatably supports, through a needle bearing 20, the cylindrical boss portion 2*c* arranged on the back of the center of the end plate 2*b* of the movable scroll member 2.

Between the boss portion 5*c* of the shaft 5 and the eccentric bushing 26, a return spring 23 constituted of a coil spring or a spiral spring is mounted, and the ends of the return spring 23 are mounted on the boss portion 5*c* and the eccentric bushing 26. In this way, the boss portion 5*c* having the eccentric pin 5*b* of the compliance crankshaft mechanism 6 and the eccentric bushing 26 make up a double eccentric mechanism. By selecting the direction in which the return spring 23 inserted between them is wound and applying a displacement beforehand to it, therefore, the boss portion 5*c* and the eccentric bushing 26 can be energized to rotate in opposite directions to each other. As a result, the return spring 23 constantly energizes the movable scroll member 2 radially outward in such a manner as to increase the orbiting radius and the amount of eccentricity of the movable scroll member 2 with respect to the shaft 5. The energizing force of the return spring 23 rotates the eccentric bushing 26 on the eccentric pin 5*b* of the shaft 5, so that the discharge capacity of the scroll-type compressor C1 restores to 100% from 0%.

Once the amount of eccentricity and the orbiting radius of the movable scroll member 2 are established in this structure, the shaft 5 is rotated by the applied driving torque. Thus, the compliance crankshaft mechanism 6 forces the movable scroll member 2 to orbit. At the same time, while the driving torque is transmitted through the eccentric bushing 26 and the eccentric pin 5*b* of the compliance crankshaft mechanism 6 making up the double eccentric mechanism, and the eccentric pin 5*b* and the eccentric bushing 26 are relatively rotated in accordance with the magnitude of the transmitted torque. Thus, the amount of eccentricity and the orbiting radius of the movable scroll member 2 are increased, thereby generating pressure of a magnitude suitable for pressing the spiral blade 2*a* of the movable scroll member 2 against the spiral blade 3*a* of the stationary scroll member 3. Also, this operation is somewhat enhanced by the return spring 23.

The component part 7 of which only the contour is shown in FIGS. 1 and 2 is an antirotation mechanism always arranged normally in the scroll-type compressor and connects the end plate 2*b* of the movable scroll member 2 and the front housing 1 to each other in such a manner as to allow the movable scroll member 2 only to orbit while preventing the rotation thereof without regard to the orbiting radius or the magnitude of the movable scroll member 2.

Figure 4A:
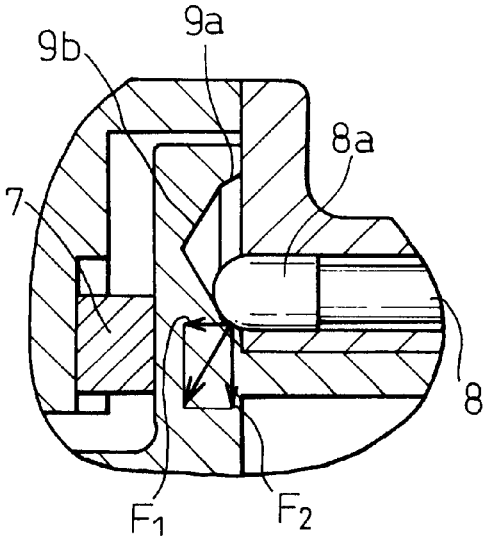
FIG. 4A is an enlarged longitudinal sectional view showing the 100% capacity operation of the essential parts of the first embodiment.
Figure 4B:
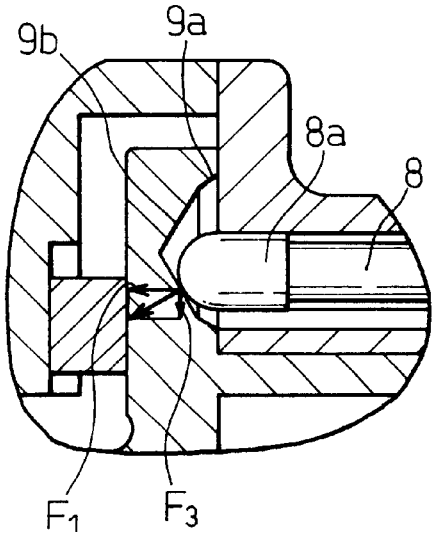
FIG. 4B shows an enlarged longitudinal sectional view of the process in transition to 0% capacity.

The greatest feature of the scroll-type compressor C1 according to the first embodiment lies in that a part of the outer shell of the stationary scroll member 3 constituting a part of the housing is formed with a small cylinder 3*b* along the axis into which the plunger 8 is slidably inserted. The hemispherical head portion 8*a* of the plunger 8 is projected from the cylinder 3*b* and is in engaging contact with the inner surface of a guide hole 9 having a two-stepped conical surface formed on the end plate 2*b* of the movable scroll member 2. In this case, as shown in FIGS. 4A and 4B, the annular conical surface at the inlet around the guide hole 9 having a comparatively small sectional inclination angle with respect to the axis of the shaft 5 is designated as 9*a*, and the conical surface having a comparatively large inclination angle on the bottom portion of the guide hole 9 is designated as 9*b*.

Numeral 10 designates a control pressure chamber formed as a space on the back of the disk portion 8*b* formed at the rear end portion of the plunger 8. Numeral 11 designates a control valve for generating a control pressure to be imparted to the control pressure chamber 10. Numeral 12 designates a discharge pressure path for introducing the discharge pressure (high-pressure) to the control valve 11, numeral 13 an intake pressure path for introducing the intake pressure (low-pressure) similarly, and numeral 24 a control pressure path for introducing the control pressure from the control valve 11 to the control pressure chamber 10. Numeral 14 designates a spring for urging the plunger 8 rightward in FIG. 1 to keep the head portion 8*a* of the plunger 8 and the guide hole 9 away from each other during the 100% capacity operation.

As is well known, in the normal scroll-type compressor, numeral 15 designates a pair of compression chambers formed between the spiral blade 2*a* of the movable scroll member 2 and the spiral blade 3*a* of the stationary scroll member 3 on the two radial sides with respect to the central portion, at which a single unified compression chamber 15*a* is formed of the particular pair of the compression chambers 15. A discharge valve 17, as a check valve, is arranged between the compression chamber 15*a* at the central portion and the discharge chamber 16 formed as a space from the back of the end plate 3*c* of the stationary scroll member 3 to the interior of the rear housing 4. Numeral 18 designates a valve stop plate for preventing the discharge valve 17 from being excessively opened.

Numeral 19 designates a bearing arranged on the front housing 1 for journaling the shaft 5, and numeral 21 tip seals arranged along the forward end surface of the movable and stationary spiral blades 2*a*, 3*a* for preventing the pressured refrigerant from leaking out of the compression chamber 15 toward the low-pressure side. Numeral 22 designates a shaft seal arranged to prevent the refrigerant from leaking outside from around the shaft 5.

The scroll-type compressor C1 according to the first embodiment has the structure described above and operates in the following way. First, as shown in FIG. 1, under the 100% capacity operating condition that exhibits the maximum discharge performance of the compressor Cl, the low intake pressure is introduced to the control pressure chamber 10 by the control valve 11. As a result, the plunger 8 is pushed rearward by the spring 14 so that the head portion 8*a* of the plunger 8 is retreated to the position where it is out of engagement with the guide hole 9. Under this condition, the head portion 8*a* has no operating effect on the movable scroll member 2. Therefore, the movable scroll member 2 assumes a maximum amount of eccentricity and, as in the normal scroll-type compressor, orbits with the maximum orbiting radius to produce the 100% discharge capacity. The relative positions of the spiral blade 2*a* of the movable scroll member 2 and the spiral blade 3*a* of the stationary scroll member 3, and the relative positions of the plunger 8 and the guide hole 9 under the 100% operation of the scroll compressor C1 are shown in the sectional view of FIG. 5.

Figure 5:
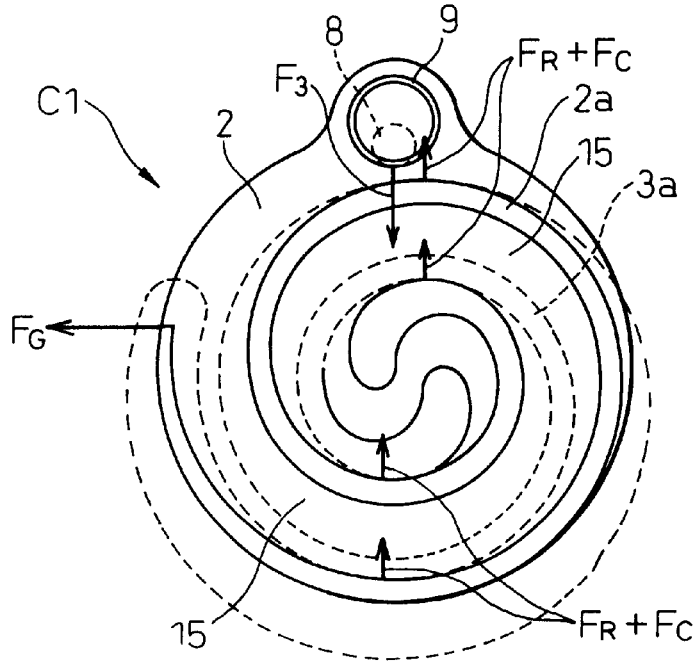
FIG. 5 is a cross side view showing the relation between the forces exerted on a compressor operating at about 100% capacity according to the first embodiment.

As indicated by arrows in FIG. 5, the spiral blade 2*a* of the movable scroll member 2 is pressed against the spiral blade 3*a* of the stationary scroll member 3 radially outward by the resultant force of the radial pressure $F_R$ generated by the relative rotation (including the relative rotation by the urging force of the return spring 23) of the eccentric bushing 26 around the eccentric pin 5*b* when the compliance crankshaft mechanism 6 transmits the driving torque on the one hand and the centrifugal force $F_C$ generated by the orbiting of the movable scroll member 2 on the other hand.

As a result, the compression chamber 15 is closed. Thus, when the movable scroll member 2 orbits and proceeds toward the central portion while being continuously contracted, the refrigerant introduced into the pair of compression chambers 15 from the intake chamber 25 on the outer peripheral portion is compressed and the pressure increases. The refrigerant thus merges into the single compression chamber 15*a* formed at the central portion and, opening the discharge valve 17 under pressure, is discharged into the discharge chamber 16. In this way, the compression reactive force $F_G$ is exerted on the movable scroll member 2 as a reaction of compression of the refrigerant in the compression chamber 15. The magnitude of the compression reactive force $F_G$ and the magnitude of the pressure $F_R$ generated by the compliance crankshaft mechanism 6 are correlated to each other.

Figure 6:
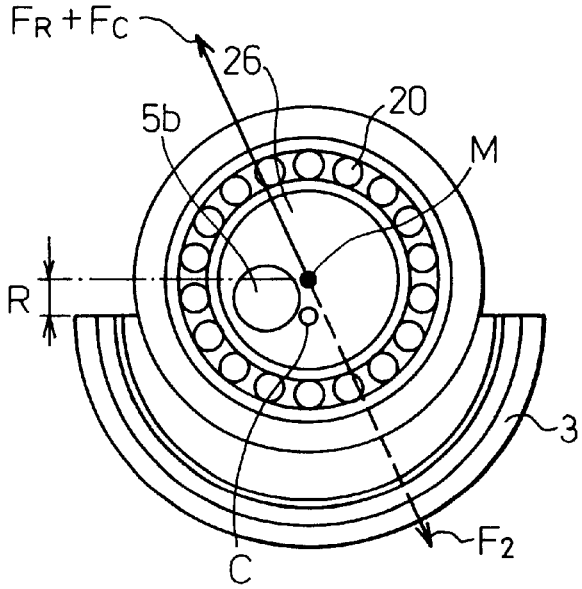
FIG. 6 is a side view showing the eccentric bushing and the neighborhood thereof in the state shown in FIG. 5.

The force for pressing the spiral blade 2*a* of the movable scroll member 2 radially against the spiral blade 3*a* of the stationary scroll member 3 is primarily the resultant force of the radial pressure $F_R$ generated in the compliance crankshaft mechanism 6 and the centrifugal force $F_C$ generated by the orbiting of the movable scroll member 2. This resultant force is indicated by the solid arrow in FIG. 6. FIG. 6 shows the operation at 100% capacity. The radial force $F_2$ as shown in FIG. 4A generated by the contact portion between the plunger 8 and the guide hole 9 is not yet generated. When the plunger 8 is activated to reduce the discharge capacity of the compressor C1 from 100% capacity, however, the radial force $F_2$ as indicated by the dashed arrow in FIG. 6 is generated and acts to offset the resultant force of the pressure $F_R$ and the centrifugal force FC described above. In FIG. 6, character C designates the center of the stationary scroll member 3, and character M the center of the movable scroll member 2. The amount of eccentricity represented by the distance between the centers C and M constitutes the orbiting radius R.

In the case where the scroll-type compressor C1 according to the first embodiment is operated with the 0% discharge capacity constituting the feature of the invention, the refrigerant, at a high discharge pressure, is introduced from the discharge chamber 16 to the control pressure chamber 10 by the switching operation of the control valve 11. As the disk portion 8*b* receives the discharge pressure, the plunger 8 is pushed toward the front against the force of the spring 14, and as shown in FIG. 2, the head portion 8*a* of the plunger 8 advances into the guide hole 9. Before the operation of 0% capacity is reached as in FIG. 2, however, the head portion 8*a* of the plunger 8 comes into contact with the conical surface 9*a* having a small inclination angle formed around the guide hole 9.

In the process, as shown in FIG. 4A, the axial force $F_1$ determined by the magnitude of the discharge pressure and the pressure-receiving area of the disk portion 8*b* of the plunger 8 is converted into the vertical (radial) force $F_2$ for pushing the movable scroll member 2 in the direction perpendicular to the axis of the shaft 5, i.e. the force for reducing the discharge capacity toward 0% at the contact point between the head portion 8*a* of the plunger 8 and the conical surface 9*a* of the guide hole 9. Since the inclination angle of the conical surface 9*a* is comparatively small, the force $F_2$ is amplified considerably with respect to the force $F_1$. When this force $F_2$ overcomes the resultant force of the radial pressure $F_R$ generated in the compliance crankshaft mechanism 6 and the centrifugal force $F_C$ acting on the movable scroll member 2, the eccentric bushing 26 rotates about the eccentric pin 5*b* against the urging force of the return spring 23. As a result, the movable scroll member 2 is moved in radial direction in such a manner as to reduce the amount of eccentricity and hence the orbiting radius R of the movable scroll member 2.

Once the amount of eccentricity and the orbiting radius of the movable scroll member 2 are reduced and the plunger 8 further moves toward the front side, the head portion 8*a* of the plunger 8, as shown in FIG. 4B, comes into contact with the second-step conical surface 9*b* on the bottom portion of the guide hole 9. The inclination angle of the conical surface 9*b* with respect to the axis of the shaft 5 is now larger than the inclination angle of the conical surface 9*a*. The vertical force $F_3$ generated in the process, therefore, is now smaller than the force $F_2$ shown in FIG. 4A. In view of the fact that the compression work is smaller with a smaller orbiting radius, however, the radial pressure is not substantially generated by the compliance crankshaft mechanism 6. Also, the smaller amount of eccentricity reduces the centrifugal force exerted on the movable scroll member 2. Even in the case where the force $F_3$ is small, therefore, the movable scroll member 2 can be moved in such a direction as to further reduce the amount of eccentricity and the orbiting radius. As a result, the movable scroll member 2 moves radially to the position where the center M thereof coincides with the center C of the stationary scroll member 3 and the shaft 5, thereby reducing the amount of eccentricity and the orbiting radius of the movable scroll member 2 to zero.

Figure 7:
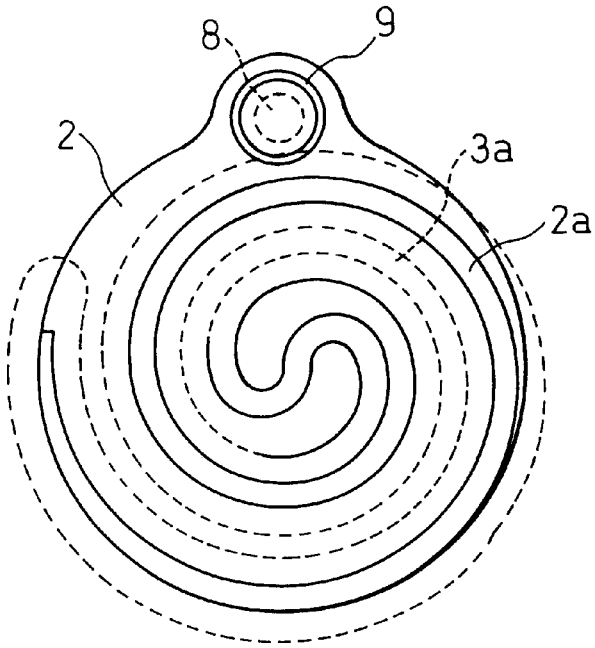
FIG. 7 is a cross side view showing a compressor operating at 0% capacity according to the first embodiment.

The 0% capacity operation with the center of the movable scroll member 2 moved radially in this way is shown in FIG. 2. FIG. 7 is a sectional view showing the positions of the spiral blade 2*a* of the movable scroll member 2 and the spiral blade 3*a* of the stationary scroll member 3, and the relative positions of the plunger 8 and the guide hole 9 under this operation condition. Under this condition, the movable scroll member 2 neither rotates nor orbits but is substantially stationary.

The force $F_3$ generated when transferring from the 100% capacity operation shown in FIG. 1 to the 0% capacity operation shown in FIG. 2 is indicated by an arrow, for the convenience sake, in FIG. 5. The force $F_3$ overcomes the resultant force of the pressure $F_R$ and the centrifugal force FC, so that the amount of eccentricity and the orbiting radius R of the movable scroll member 2 are reduced to zero. Specifically, according as the hemispherical head portion 8*a* of the plunger 8 advances into the guide hole 9, the orbiting radius R and the amount of eccentricity of the movable scroll member 2 are progressively reduced. Thus, the movable scroll member 2 ceases to orbit, so that the centrifugal force $F_C$ due to the orbiting is reduced and finally becomes zero. On the other hand, the compression chamber 15 formed between the spiral blades 2*a* and 3*a* opens and ceases to be closed, and therefore the refrigerant is not compressed. Thus, the drive torque approaches zero, and so does the radial pressure $F_R$ generated in the compliance crankshaft mechanism 6. This is also the case with the compression reaction FG.

Figure 8:
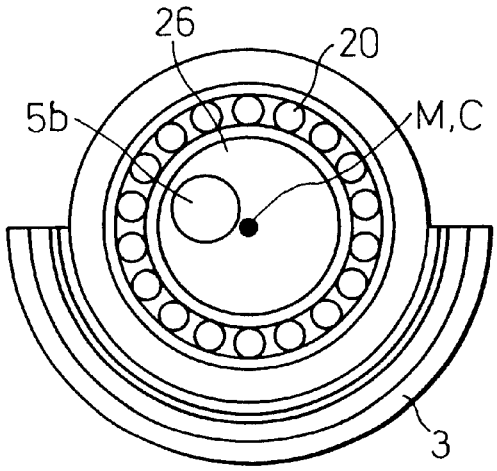
FIG. 8 is a side view showing the eccentric bushing and the neighborhood thereof in the state shown in FIG. 7.

Further, the resultant force of the centrifugal force $F_C$ and the pressure $F_R$ assumes a value approximate to zero. Thus, the force $F_3$ generated in the contact portion between the plunger 8 and the guide hole 9 against the resultant force increases beyond the particular resultant force. As a result, as shown in FIG. 8, the center M of the movable scroll member 2 comes to coincide with the center C of the stationary scroll member 3, so that the amount of eccentricity and the orbiting radius R of the movable scroll member 2 become zero and the compressor C1 enters the 0% capacity operation. The radial force $F_3$ is not so large. As long as the compressor C1 is in 0% capacity operation, however, the radial force $F_3$ is not reduced to zero as it works against the urging force of the return spring 23.

In the case where the guide hole 9 is formed only of a conical surface 9*a* having a small inclination angle, the force $F_2$ increases for moving the movable scroll member 2 in such a radial direction as to reduce the amount of eccentricity and the orbiting radius. In view of the fact that the radial movement of the scroll member 2 is small as compared with the axial movement of the head portion 8*a* of the plunger 8, however, the need arises to increase the depth of the guide hole 9, thereby making it impossible to form the guide hole 9 within the thickness range of the end plate 2*b* of the movable scroll member 2. For this reason, the depth of the guide hole 9 is reduced by increasing the inclination angle of the second-step conical surface 9*b*. In spite of this, at the position where the head portion 8*a* engages the conical surface 9*b*, the orbiting radius is reduced, and the radial pressure $F_R$ of the compliance crankshaft mechanism 6 assumes a small value of substantially zero and the centrifugal force $F_C$ exerted on the movable scroll member 2 is reduced. Therefore, even in the case where the force $F_3$ is smaller than the force $F_2$, the movable scroll member 2 can be moved in a radial direction. Also, this makes it possible to reduce the distance coverage of the plunger 8 in axial direction.

In the case where the scroll-type compressor C1 according to the first embodiment is used as a refrigerant compressor for the refrigeration cycle of the air-conditioning system, if the plunger 8 advances deep into the guide hole 9 so that the amount of eccentricity and the orbiting radius R of the movable scroll member 2 become zero, and the discharge capacity of the compressor C1 decreases from 100% to 0%, even when the high-pressure upstream of the expansion valve in the refrigeration cycle gradually decreases to uniform pressure, the compressor C1 continues operating at the discharge capacity of 0% as long as the axial force $F_1$ generated by the pressure of the control pressure chamber 10 received by the disk portion 8*b* of the plunger 8 remains larger than the resultant force of the force of the spring 14 and the return spring 23.

In restoring the operation of the 100% discharge capacity from this state again, the intake pressure (low-pressure) is introduced into the control pressure chamber 10 by the control valve 11. As a result, the urging force of the spring 14 moves the plunger 8 rearward. In the compliance crankshaft mechanism 6, therefore, the eccentric bushing 26 and the needle bearing 20 rotate about the eccentric pin 5*b* by the urging force of the return spring 23, thereby increasing the orbiting radius R and the amount of eccentricity of the movable scroll member 2. With the increase in the amount of eccentricity, the centrifugal force $F_C$ applied to the movable scroll member 2 increases. Thus, the amount of eccentricity and the orbiting radius R further increase with the result that the operation with the 100% discharge capacity is restored.

As described above, with the scroll-type compressor C1 according to the first embodiment, the amount of eccentricity and the orbiting radius R of the movable scroll member 2 can be easily and smoothly reduced to zero by adding a simple mechanism including the plunger 8 to the conventional scroll-type compressor. In the 0% capacity operation, therefore, the needle bearing 20, the bearing 19 and the shaft seal 22 constitute the only sliding or rolling portions, thereby realizing the 0% capacity operation with a very small power loss.

Figure 9:
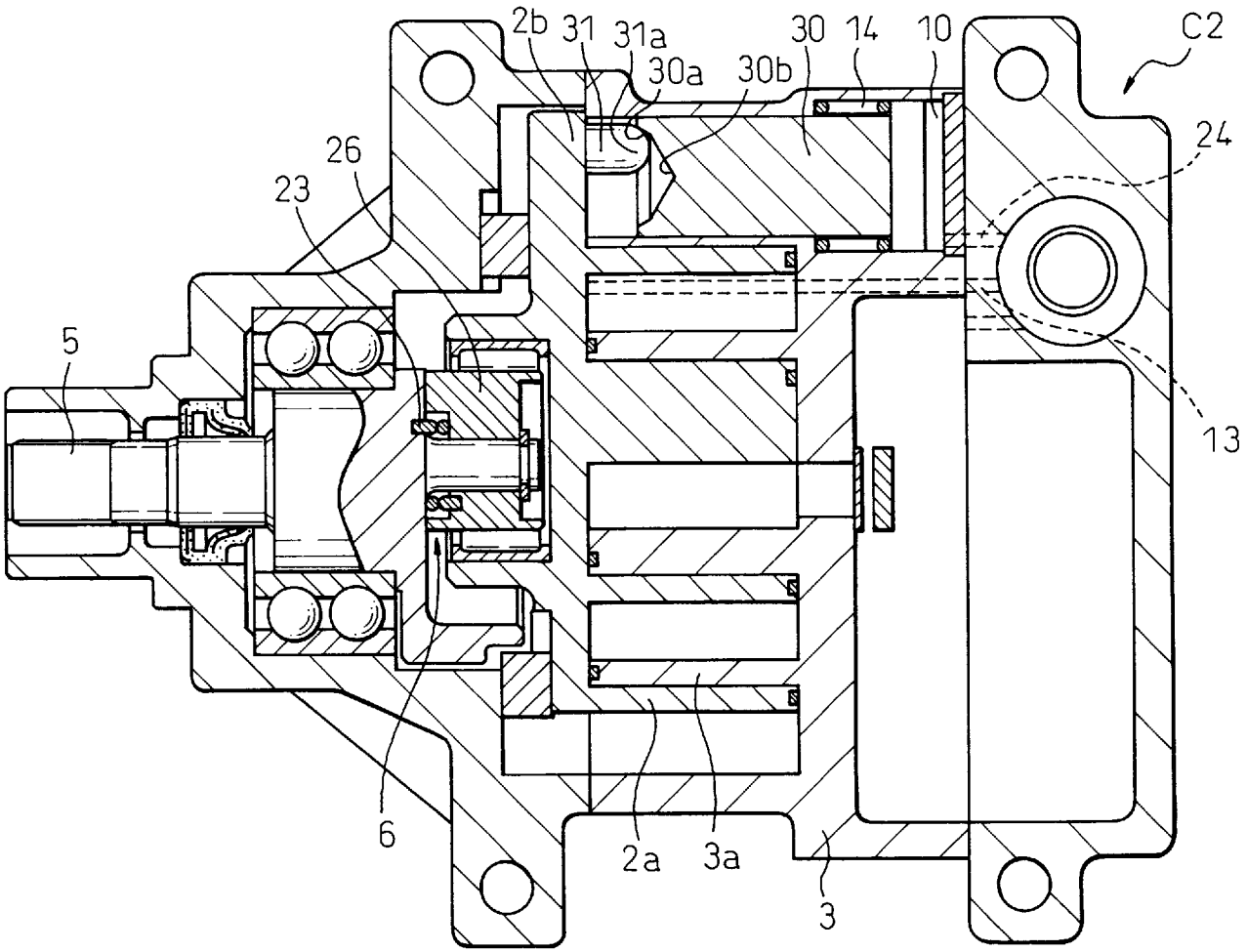
FIG. 9 is a longitudinal front view of a compressor operating at 100% capacity according to a second embodiment of the invention.

FIG. 9 shows a structure of the scroll-type compressor C2 according to a second embodiment of the invention. This scroll-type compressor C2 is different from the scroll-type compressor C1 according to the first embodiment in that the relative positions of the plunger 8 and the guide hole 9 are opposite to each other. Specifically, according to the second embodiment, the plunger 30 is thicker than the plunger 8 and has the forward end surface thereof formed with guide holes 30*a*, 30 having two-stepped conical surface as a depression. Also, a corresponding guide pin 31 is mounted on the side of the end plate 2*b* of the movable scroll member 2, and the hemispherical head portion 31*a* at the forward end of the guide pin 31 is adapted to engage the guide holes 30*a*, 30*b*. The remaining structure is substantially the same as the corresponding structure of the first embodiment. The scroll-type compressor C2 according to the second embodiment of course operates substantially the same way as the compressor C1 according to the first embodiment.

Figure 10:
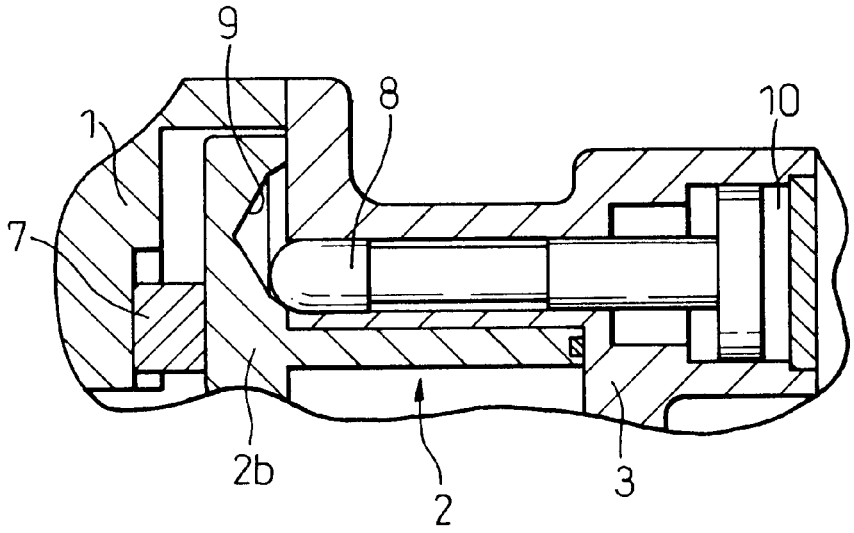
FIG. 10 is a longitudinal sectional view showing the essential parts of a specific example of a third embodiment.
Figure 11:
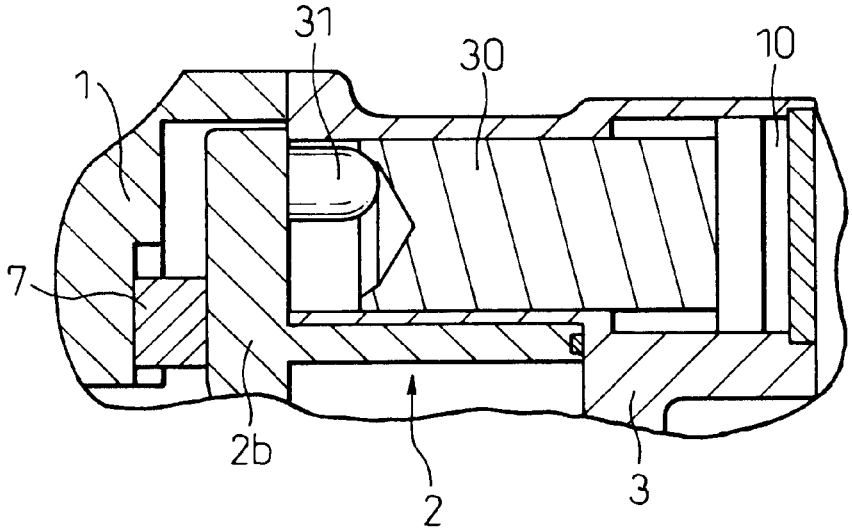
FIG. 11 is a longitudinal sectional view showing the essential parts of another specific example of the third embodiment.

FIGS. 10 and 11 show a structure of the essential parts of the scroll-type compressor C1 of the first embodiment and the scroll-type compressor C2 of the second embodiment according to a modification constituting a third embodiment of the invention. The structure of FIG. 10 corresponds to the first embodiment (FIGS. 1 and 2), and the structure of FIG. 11 corresponds to the second embodiment (FIG. 9). As compared with these embodiments, the third embodiment has the feature in that it does not have a spring 14 for urging the plunger 8 or the plunger 30. The spring 14 according to the first and second embodiments constantly keeps the plunger 8 or 30 urged toward the control pressure chamber 10. In the 100% capacity operation, therefore, the head portion of the plunger is retreated to a position completely out of contact with the guide holes. According to the third embodiment lacking the spring 14, however, the head portion of the plunger remains in light contact with the guide holes even under the 100% operation. Since the force acting on the movable scroll member 2 to rotate it is supported by the antirotation mechanism 7, however, the problem is not posed of a heavy load being imposed on the contact portion between the plunger head portion and the guide holes.

Although the general configuration of the compressor according to the third embodiment is not shown, as is obvious from the shown structure of the first and second embodiments, the compressor according to the third embodiment operates substantially the same way as the compressor according to the first (or second) embodiment in the case where the 100% capacity operation is turned to the 0% capacity operation or the other way around.

Figure 12:
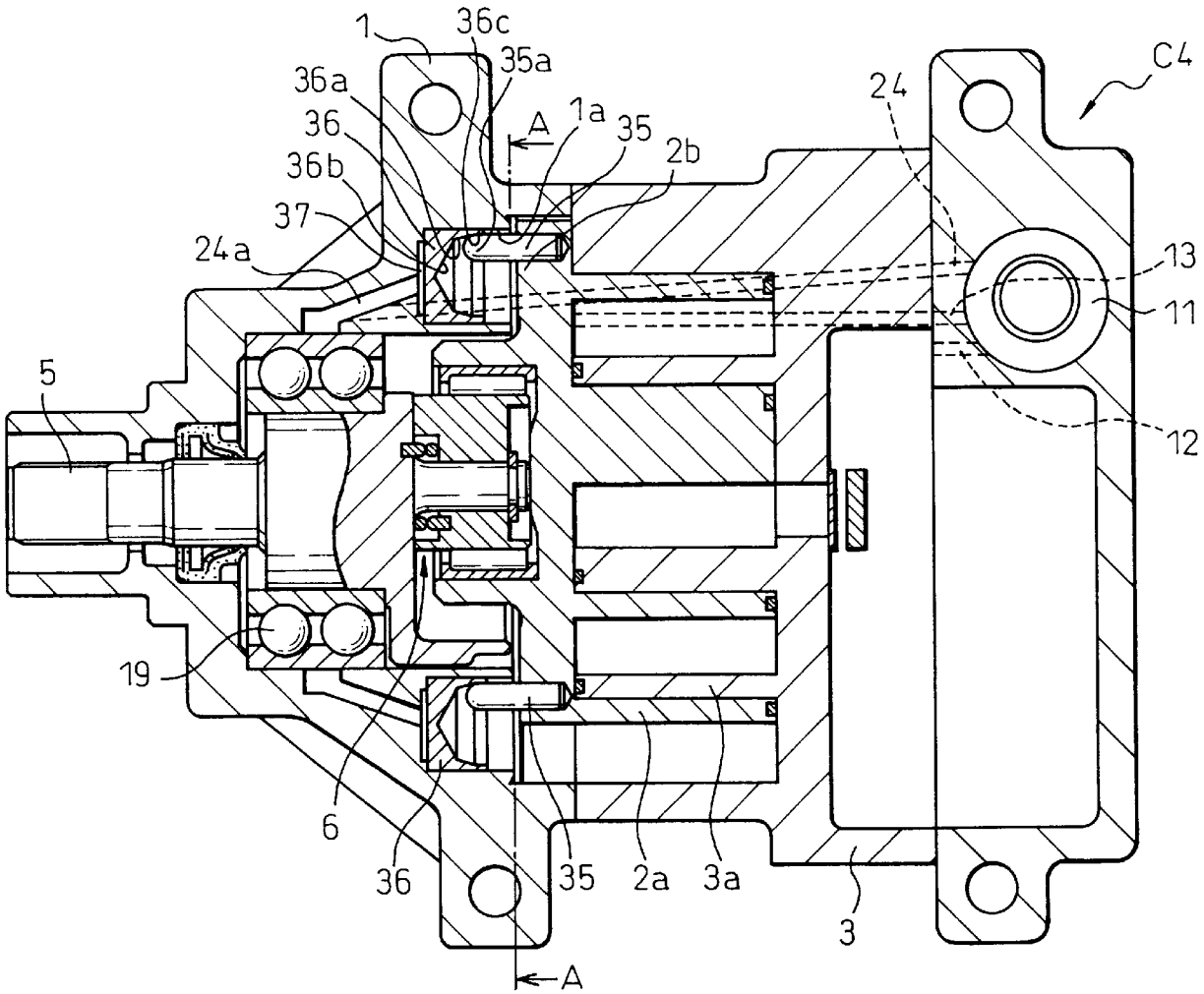
FIG. 12 is a longitudinal front view showing a compressor operating at 100% capacity according to a fourth embodiment of the invention.
Figure 13:
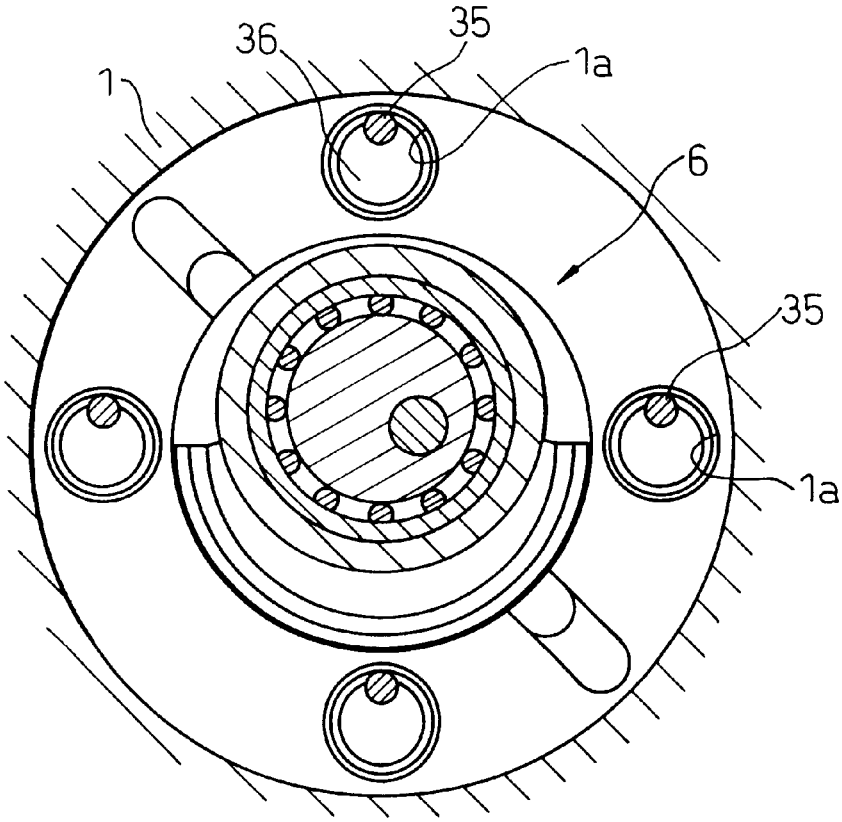
FIG. 13 is a cross sectional view taken in line A—A in FIG. 12, showing a compressor operating at 100% capacity according to the fourth embodiment of the invention.
Figure 14:
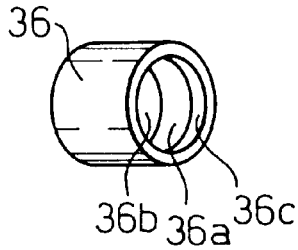
FIG. 14 is an enlarged perspective view showing the essential parts of the fourth embodiment.

FIGS. 12 to 15 show the configuration and the operation of a scroll-type compressor C4 according to a fourth embodiment of the invention. The feature of the fourth embodiment lies in that a plunger 36 having the shape shown in FIG. 14 is slidably inserted into each of cylinders 1*a* formed axially on the inner side surface of a front housing 1, and guide holes 36*a*, 36*b* constituting a two-stepped conical surface are formed in the end surfaces of the plunger 36. A guide pin 35 having a hemispherical head portion 35*a* engaging the guide holes 36*a*, 36*b* is arranged on the side of the end plate 2*b* of the movable scroll member 2. The bottom portion of the cylinder for receiving the plunger 36 is formed with a control pressure chamber 37 as a space, which communicates with a control valve 11 through a control pressure path 24*a* formed in the front housing 1 to connect a control pressure path 24.

Several pairs, or specifically, about four pairs of the guide pin 35 and the plunger 36 can be arranged at equidistant positions around the shaft 5 as shown in the sectional view of FIG. 13 taken in line A—A in FIG. 12. According to the fourth embodiment, a short cylindrical surface 36*c* is formed on the inlet side connected to each guide hole 36*a*. In the operating condition shown in FIG. 12 with the cylindrical surface 36*c* in engagement with the guide pin 35, therefore, the compressor C4 is ready for 100% capacity operation. Under this operating condition, the engagement between the cylindrical surface 36*c* and the guide pin 35 prevents the orbiting of the movable scroll member 2, and therefore the compressor C4 according to the fourth embodiment is not provided with the antirotation mechanism 7 unlike in the other embodiments described above. Even under the operating condition of less than 100%, the hemispherical head portion 35*a* of each guide pin 35 in engagement with the conical surface of the guide holes 36*a*, 36*b* of the plunger 36 prevents the orbiting of the movable scroll member 2. A similar configuration can be employed also for each of the embodiments described above, and therefore the provision of the antirotation mechanism 7 is not the essential requirement of the compressor according to the invention.

Figure 15:
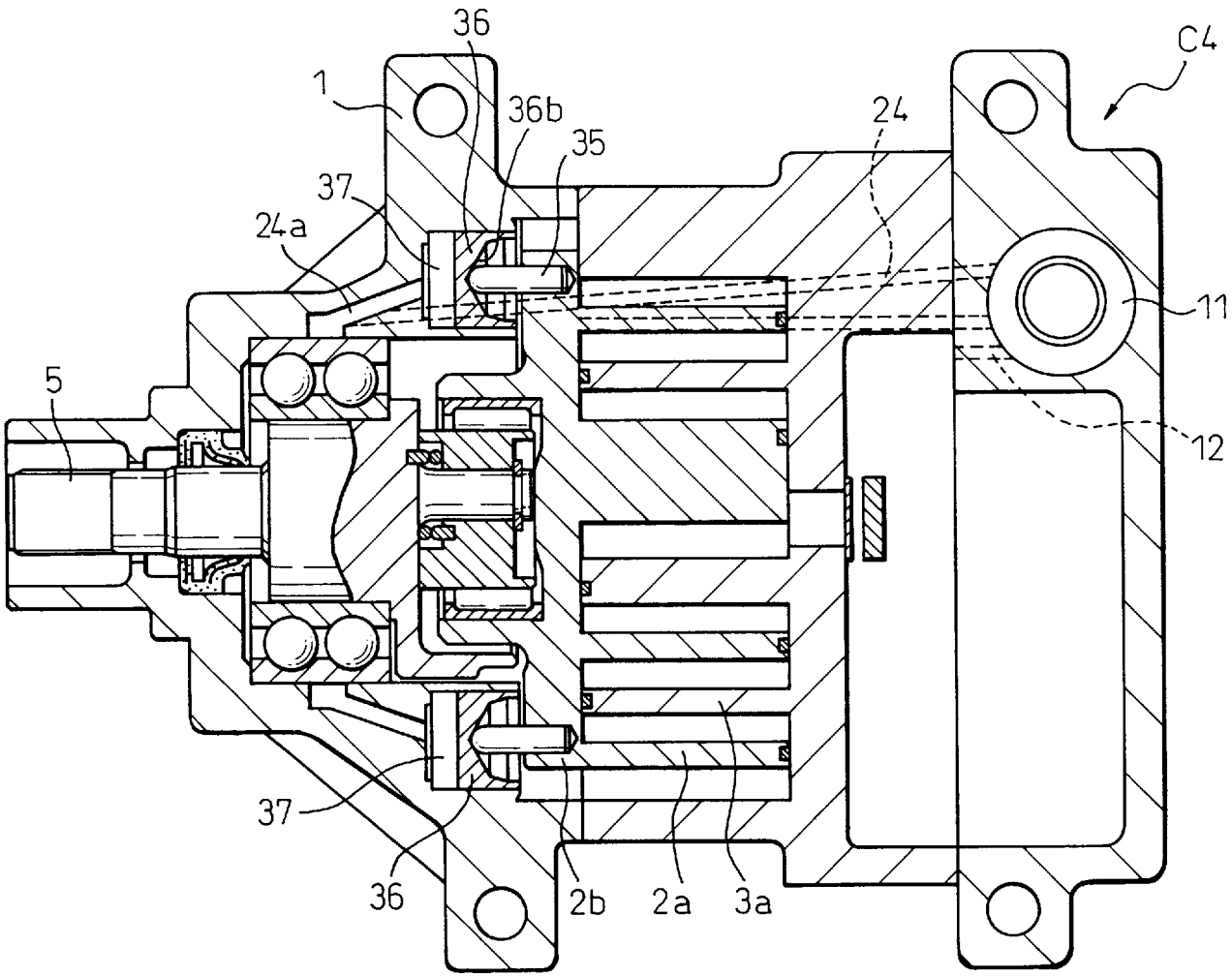
FIG. 15 is a longitudinal front view of a compressor operating at 0% capacity according to the fourth embodiment.

The operating condition at 0% capacity of the scroll-type compressor C4 according to the fourth embodiment is shown in FIG. 15. For reducing the discharge capacity from the operating condition of 100% capacity shown in FIG. 12 to the 0% capacity operation, as in each of the embodiments described above, the control valve 11 is switched to introduce the high discharge pressure into the control pressure chamber 37. As a result, the plunger 36 moves rightward in FIG. 12, and therefore the guide pin 35 is forcibly moved radially toward the center of the guide hole 36*b*. At the same time, the movable scroll member 2 moves radially so that the amount of eccentricity and the orbiting radius are reduced. Finally, as shown in FIG. 15, the hemispherical head portion 35*a* of the guide pin 35 drops to the center of the guide hole 36*b* of the plunger 36. Thus, the amount of eccentricity and the orbiting radius of the movable scroll member 2 are reduced to zero, and the 0% capacity operation is realized.

Under the 0% capacity operation, the discharge capacity is reduced substantially to zero, so that the internal pressure of the refrigeration cycle of the air-conditioning system is gradually equalized. Even after the pressure of the control pressure chamber 37 decreases to a positive value near zero, only the urging force of the return spring 23 works in such a direction as to increase the amount of eccentricity and the orbiting radius of the movable scroll member 2 under the 0% capacity operating condition as long as the pressure receiving area of the plunger 36 is set to a certain magnitude. Thus, the radial pressure $F_R$ and the centrifugal force $F_C$ generated in the compliance crankshaft mechanism 6 are zero, and therefore as long as the pressure of the control pressure chamber 37 assumes a positive value, the 0% capacity operation can be maintained against the urging force of the return spring 23. For increasing the discharge capacity again toward 100% capacity, the control valve 11 is switched to introduce a lower intake pressure (negative pressure) to the control pressure chamber 37.

The provision of a plurality of pairs of the guide pin 35 and the plunger 36 and the equidistant arrangement thereof around the shaft 5 as in the fourth embodiment make it possible to push the end plate 2*b* of the movable scroll member 2 uniformly along the axis. As compared with the first embodiment having only a pair of the plunger 8 and the guide hole 9, therefore, a smoother operation of controlling the discharge capacity is assured. Also, the smaller axial pressure per each point eliminates the likelihood of generating vibration when changing the discharge capacity, thereby improving the reliability of the compressor.

Figure 16A:
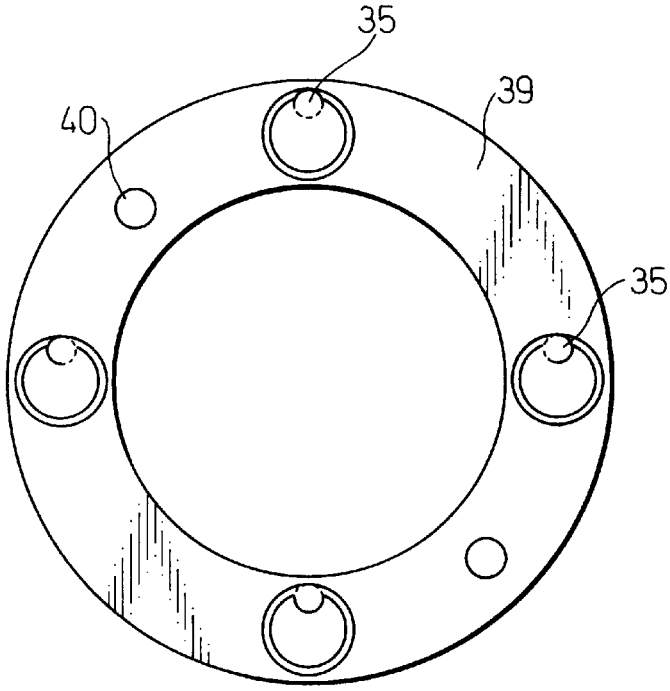
FIG. 16A is an enlarged side view showing an annular plunger with guide pins both constituting the essential parts of a compressor according to a fifth embodiment.
Figure 16B:
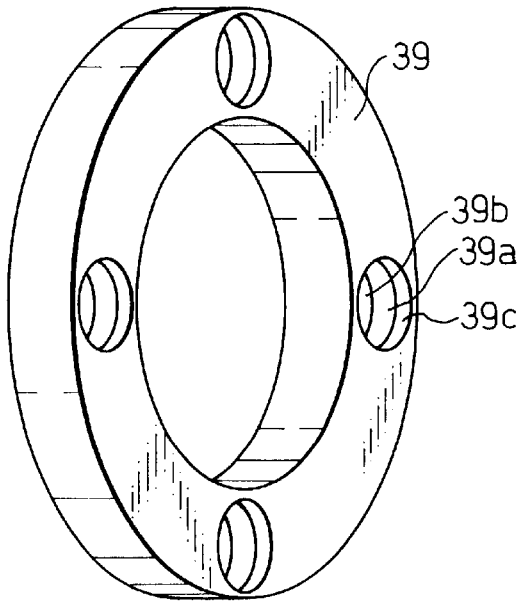
FIG. 16B is a perspective view of the annular plunger according to the fifth embodiment.

FIGS. 16A and 16B show a configuration of the essential parts of the scroll-type compressor C4 according to a fifth embodiment as modified from the fourth embodiment of the invention. The feature of the fifth embodiment lies in the use of an annular plunger 39. Though not shown, an annular cylinder is arranged on the inner side surface of the front housing 1 to receive the annular plunger 39. An annular control pressure chamber is formed on the bottom of the annular cylinder and connected through the control pressure path 24 to the control valve 11. Guide holes including two-stepped conical surfaces 39*a*, 39*b* and a cylindrical surface 39*c* are formed at several equidistant positions on the annular plunger 39. A guide pin 35 protruded axially from the end plate 2*b* of the movable scroll member 2 is arranged in engagement with each of the guide holes. As shown in FIG. 16A, the annular plunger 39 is formed with holes 40, into each of which a pin (not shown) formed on the side surface of the front housing 1 is axially loosely inserted, thereby preventing the annular plunger 39 from rotating.

The fifth embodiment uses the annular plunger 39, and therefore the effective area is increased. An axial force larger than in the fourth embodiment is generated, therefore, even by the low discharge pressure substantially zero at the 0% capacity operation. Thus, the amount of eccentricity and the orbiting radius of the movable scroll member 2 can always be reduced zero and the stable 0% capacity operation can be maintained.

Figure 17:
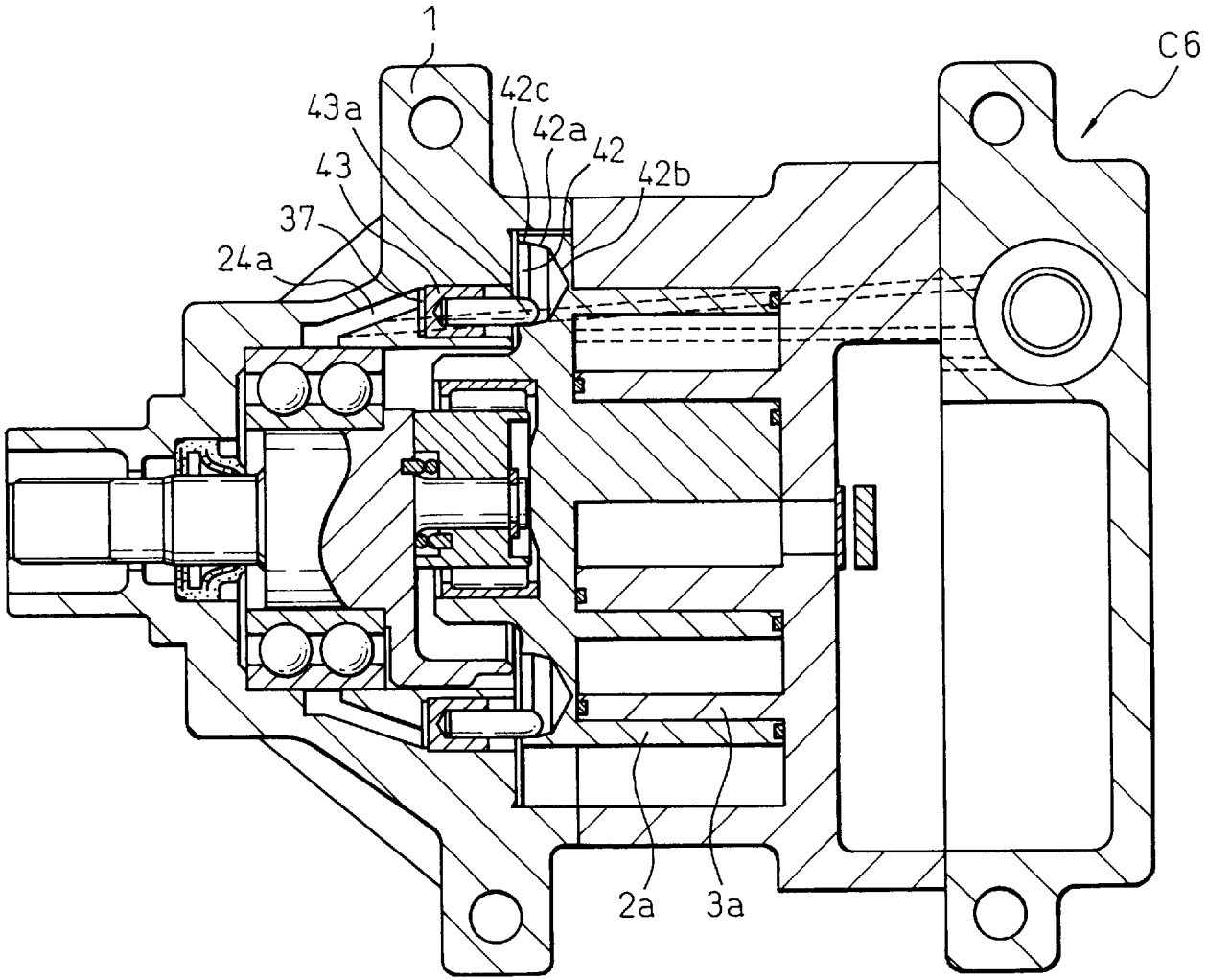
FIG. 17 is a longitudinal front view showing a compressor operating at 100% capacity according to a sixth embodiment.
Figure 18:
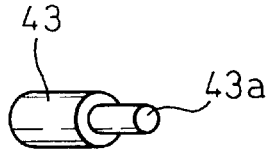
FIG. 18 is a perspective view showing in enlarged form the essential parts the sixth embodiment of the invention.

FIG. 17 shows a structure of the scroll-type compressor C according to a sixth embodiment of the invention. The essential parts of this compressor are shown in FIG. 18. As compared with the fourth embodiment (FIG. 12), the feature of the sixth embodiment lies in that the relative positions of the plunger head portions and the guide holes are opposite to each other. According to the sixth embodiment, the guide holes 42 are formed in the end plate 2*b* of the movable scroll member 2, and each include two-stepped conical surfaces 42*a*, 42*b* and a cylindrical surface 42*c*. On the other hand, the plunger 43 is inserted into the cylinder formed on the front housing 1 so that each hemispherical head portion 43*a* at the forward end of the plunger 43 is adapted to engage corresponding one of the guide holes 42. The plunger 43 is shown in enlarged form in FIG. 18. The operation of the sixth embodiment is substantially similar to that of the fourth embodiment.

Figure 19A:
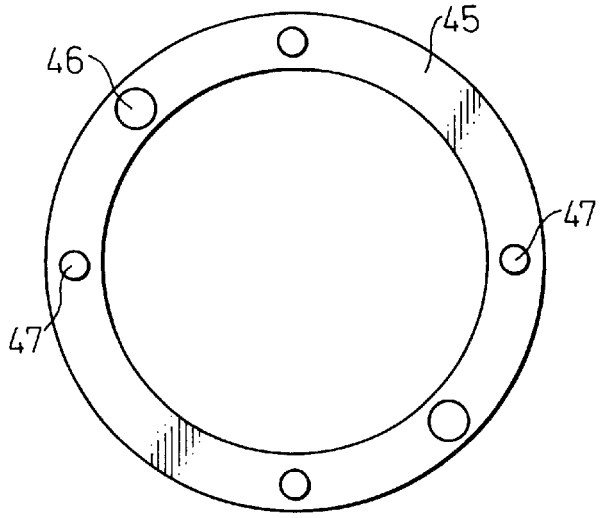
FIG. 19A is a side view showing in enlarged form an annular plunger constituting the essential parts of a compressor according to a seventh embodiment of the invention.
Figure 19B:
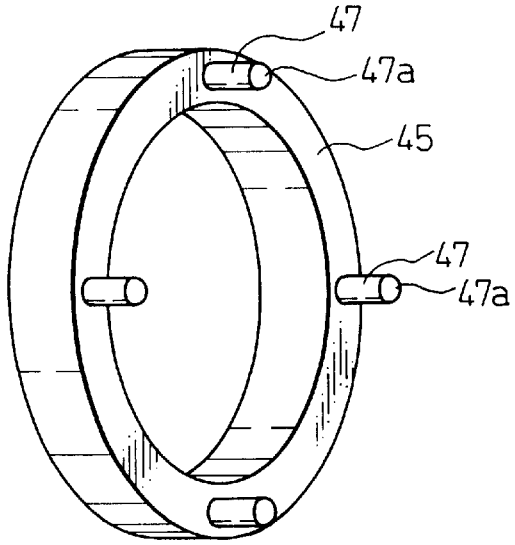
FIG. 19B is a perspective view showing the annular plunger according to the seventh embodiment with pins.

FIGS. 19A and 19B show a configuration of the essential parts of the scroll-type compressor C6 (FIG. 17) according to a seventh embodiment of the invention modified from the sixth embodiment. In the seventh embodiment, as in the fifth embodiment (FIG. 16) described above, a single annular plunger 45, instead of a plurality of plungers, is used. The feature of the seventh embodiment is that a plurality of pins 47 are formed to protrude radially from the annular plunger 45, and the hemispherical head portion 47*a* at the forward end of each of the pins 47 is in engagement with the corresponding one of the guide holes 42 shown in FIG. 17. In FIG. 19, reference numeral 46 designates holes into which pins not shown are inserted to block the rotation of the annular plunger 45. The compressor according to the seventh embodiment, of which the general configuration is not shown, has a shape similar to FIG. 17. The operation of this embodiment is substantially the same as that of the fifth embodiment.

Figure 20:
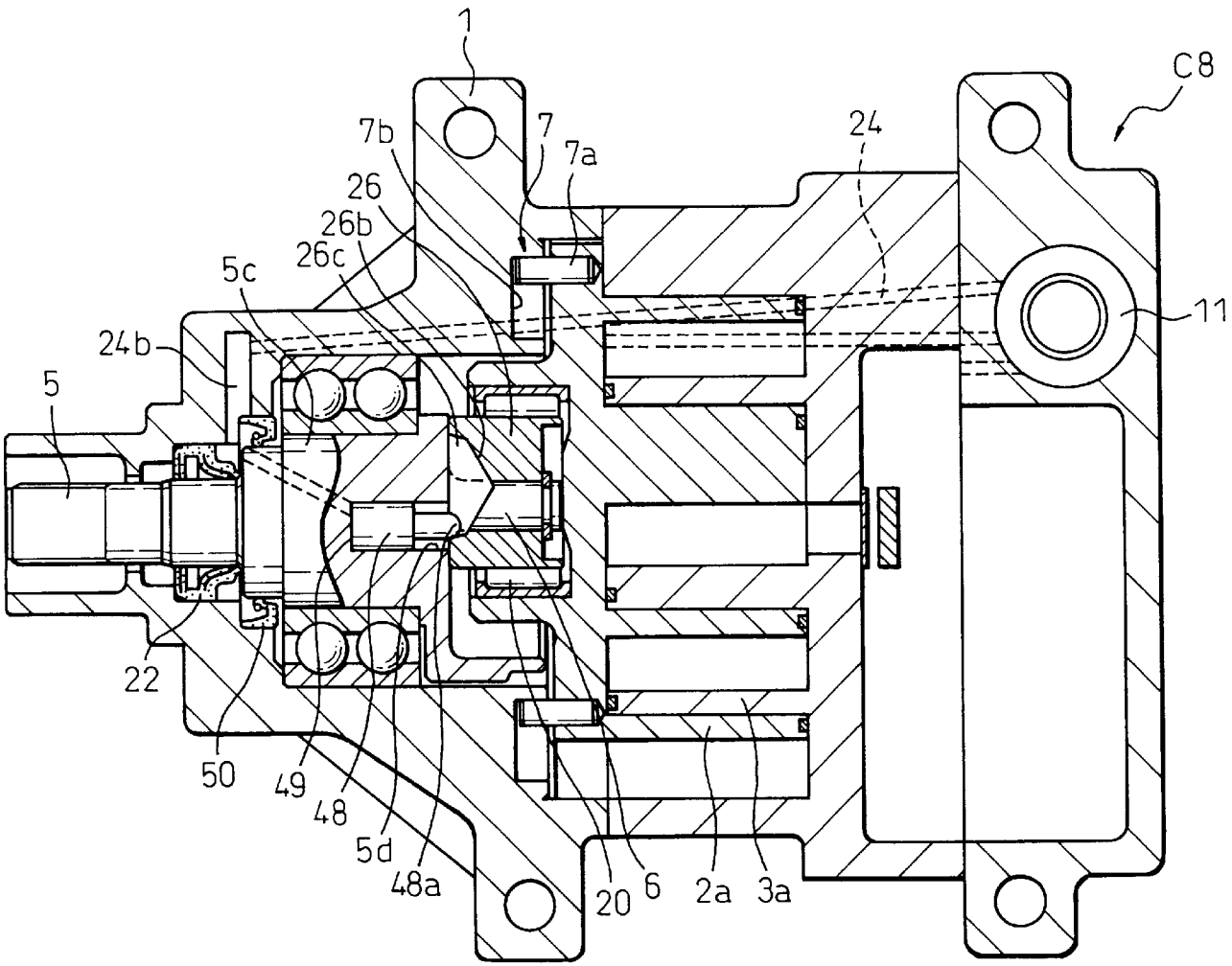
FIG. 20 is a longitudinal front view of a compressor operating at 100% capacity according to an eighth embodiment.

FIG. 20 shows a structure of the scroll-type compressor C8 according to an eighth embodiment of the invention. According to the eighth embodiment, the antirotation mechanism 7 is illustrated specifically as a mechanism including pins 7*a* and circular depressions 7*b*. Each of a plurality of the pins 7*a* and the corresponding one 7*b* of a plurality of the circular depressions 7*b* are paired with each other. Each one of the pins 7 is arranged on the end plate 2*b* of the movable scroll member 2, while the corresponding circular depression 7*b* is arranged on the front housing 1. Nevertheless, the relative positions of the pin 7*a* and the circular depression 7*b* may be opposite.

The feature of the eighth embodiment lies in that the plunger 48 is inserted into the cylinder 5*d* formed on the boss portion 5*c* of the shaft 5, and the hemispherical head portion 48*a* at the forward end of the plunger 48 is in engagement with a guide hole including two-stepped conical surfaces 26*b*, 26*c* formed on an eccentric bushing 26. The conical surfaces 26*b*, 26*c* according to the eighth embodiment have a similar shape to the conical surfaces 9*a*, 9*b* of the guide hole 9 according to the first embodiment shown in FIG. 4. In FIG. 20, numeral 49 designates a control pressure chamber formed on the bottom portion of the cylinder 5*d* for the plunger 48, and numeral 50 a shaft seal formed to prevent the leakage of the control pressure to the low-pressure intake side from the control pressure path 24*b* midway of the control pressure path 24 extending from the control valve 11 to the control pressure chamber 49.

The operation of the compressor C8 according to the eighth embodiment is substantially similar to that of the fourth or sixth embodiment. According to the eighth embodiment, however, unlike in the first embodiment having such a structure that the guide hole 9, formed only at one point distant from the shaft 5, is pressed by the head portion 8*a* of the plunger 8, the guide hole formed in the eccentric bushing 26 at a position near the center of the movable scroll member 2 is pressed by the plunger 48, and therefore the whole movable scroll member 2 can be uniformly pressed. Thus, a smoother control operation is assured for changing the discharge capacity, thereby leading to a lesser likelihood of generating vibration.

Figure 21A:
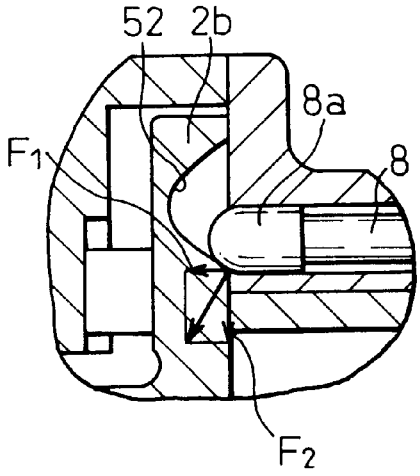
FIG. 21A is a longitudinal sectional view showing the essential parts of a compressor operating at about 100% capacity according to a ninth embodiment.
Figure 21B:
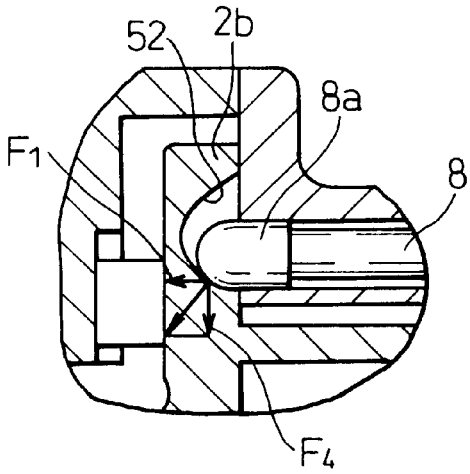
FIG. 21B is a diagram showing the discharge capacity being reduced according to the ninth embodiment.
Figure 21C:
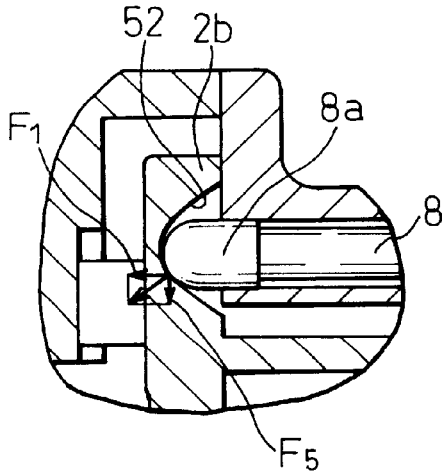
FIG. 21C is a diagram showing the same compressor of the ninth embodiment operating at about 0% capacity.

FIGS. 21A, 21B, 21C show a structure of the essential parts of the compressor according to a ninth embodiment of the invention and the operation thereof. A general configuration of this compressor is similar to that of the scroll-type compressor C1 according to the first embodiment shown in FIG. 1. Unlike in the embodiments described above, in which the guide hole has a two-stepped conical surface, the ninth embodiment is such that the surface of the guide hole 52 formed in the end plate 2*b* of the movable scroll member 2 is smoothly curved like a paraboloid of revolution or a hyperboloid of revolution. As a result, when the state of FIG. 21A changes to the state of FIG. 21C through the state of FIG. 21B, i.e. according as the head portion 8*a* of the plunger 8 engaging the guide hole 52 approaches the bottom portion of the guide hole 52, the angle between the surface of the engaged portion and the center axis of the shaft 5 increases steplessly. Thus, the discharge capacity can be controlled more smoothly than when the two-stepped conical surface is used.

Now, with reference to FIGS. 22 to 25, the scroll-type compressor C10 according to a tenth embodiment of the invention will be explained. In each of the embodiments described above, the counterweight 5*a* is integrated with the boss portion 5*c* of the shaft 5, and therefore the vibration generated by the orbiting of the movable scroll member 3 could be suppressed, but the radial pressure generated by the centrifugal force acting on the movable scroll member 2 could not be suppressed. In the harsh operating condition, the shaft 5 is rotated at high speed with 100% capacity, therefore, the centrifugal force acting on the movable scroll member 2 increases to such an extent that the spiral blade 2*a* is strongly pressed against the spiral blade 3*a* of the stationary scroll member 3. The resulting likelihood of wearing the blade surface poses the problem of the reduced reliability of the compressor operating under heavy load at high speed.

In order to solve this problem, the compressor C10 according to the tenth embodiment comprises a counter weight 54 as a part independent of the boss portion 5*c* of the shaft 5 and movable with respect to the latter. The counter weight 54, as shown in FIGS. 23 and 24, is partly formed with a large circular hole 54*a* for receiving the outer peripheral surface 26*d* of the end portion of the eccentric bushing 26 with a sufficient margin and allowing the eccentric bushing 26 to move in radial direction, a circular hole 54*b* sufficiently larger in diameter than the outer diameter of the boss portion 5*c* of the shaft 5 for receiving the outer peripheral surface 5*e* of the boss portion 5*c* with a margin, and a radial groove (called a bifacial groove) 54*c* having a predetermined width.

As a part corresponding to the bifacial groove 54*c* formed in the counter weight 54, a radial protrusion (called a bifacial protrusion) 5*d* having a predetermined width is formed at the end surface of the boss portion 5*c* of the shaft 5 and slidably engages the bifacial groove 54*c* of the counter weight 54. The other configuration is substantially similar to that of the scroll-type compressor C1 according to the first embodiment.

Figure 22:
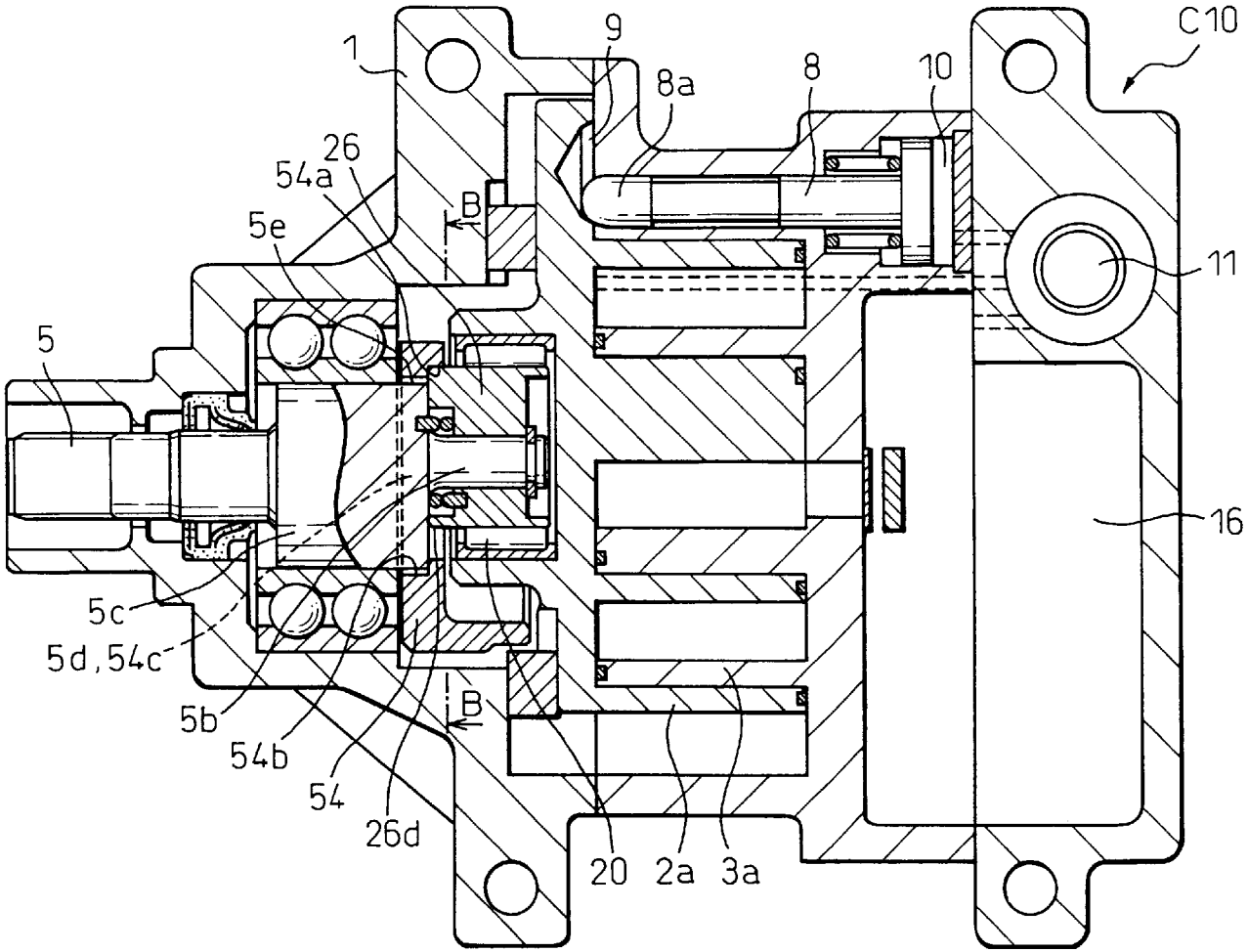
FIG. 22 is a longitudinal front view showing a compressor operating at 100% capacity according to a tenth embodiment.
Figure 23:
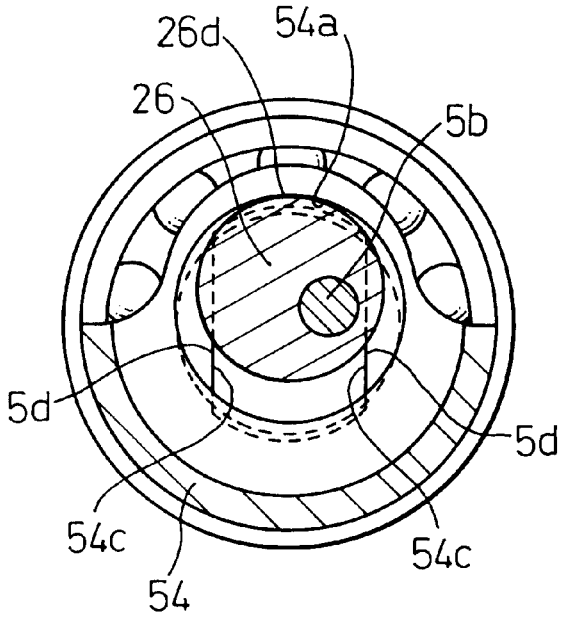
FIG. 23 is a cross side view taken in line B—B in FIG. 22, showing the essential parts of a compressor operating at 100% capacity according to the tenth embodiment.

The compressor C10 according to the tenth embodiment has the structure described above and, therefore, under the operating condition at 100% capacity shown in FIGS. 22 and 23, the eccentric bushing 26 and the counter weight 54 are rotated in operatively interlocked relation to each other with a part of the outer peripheral surface 26*d* of the eccentric bushing 26 in contact with a part of the inner surface of the circular hole 54*a* of the counter weight 54. The shaft 5 and the counter weight 54 are rotated in operatively interlocked relation with each other by the engaging portion between the bifacial protrusion 5*d* of the shaft 5 and the bifacial groove 54*c* of the counter weight 54, while the shaft 5 and the eccentric bushing 26 are rotated in operatively interlocked relation to each other by the eccentric pin 5*b* of the shaft 5 and the circular hole 54*a* of the counter weight 54 in contact with the outer peripheral surface 26*d* of the end portion of the eccentric bushing 26. The centrifugal force due to the orbiting motion is exerted on the movable scroll member 2. Nevertheless, the force offsetting the centrifugal force is generated by the counter weight 54, and transmitted to the movable scroll member 2 from the contact point between the outer peripheral surface 26*d* of the end portion of the eccentric bushing 26 and the circular hole 54*a* of the counter weight 54.

Figure 24:
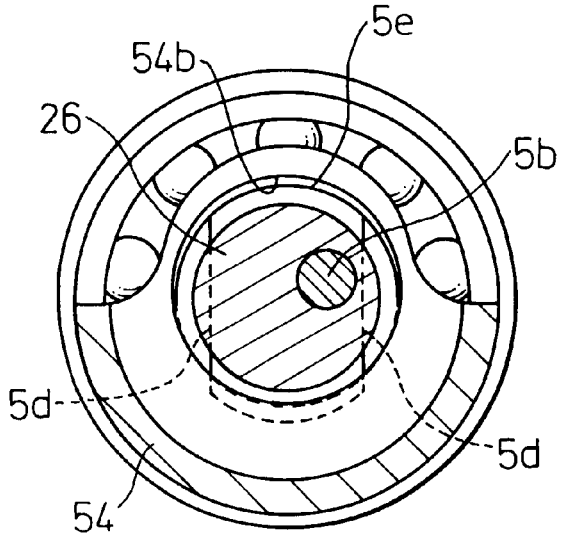
FIG. 24 is a cross side view taken in line D—D in FIG. 25, showing the essential parts of a compressor operating at 0% capacity according to the tenth embodiment.
Figure 25:
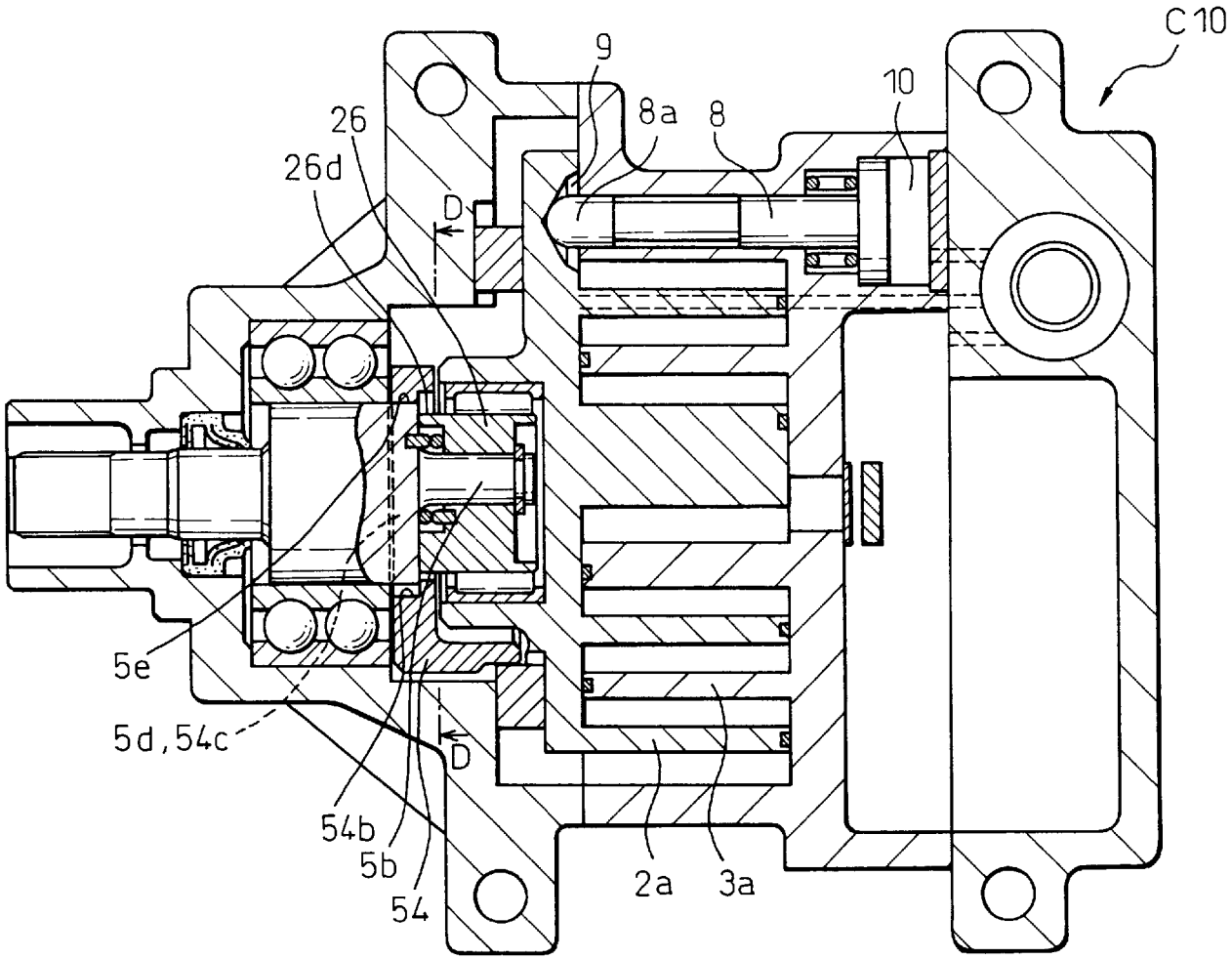
FIG. 25 is a longitudinal front view of a compressor operating at 0% capacity according to the tenth embodiment.

In the process of transferring from the operating condition at 100% capacity shown in FIGS. 22 and 23 to the operating condition at 0% capacity shown in FIGS. 24 and 25 as the result of reduction in discharge capacity, the counterweight 54 maintains the contact between the inner surface of the circular hole 54*a* and the outer peripheral surface 26*d* of the end portion of the eccentric bushing 26 until the inner surface of the circular hole 54*b* comes into contact with the outer peripheral surface 5*e* of the end portion of the boss portion 5*c* of the shaft 5. In the process, the bifacial groove 54*c* being in mesh with the bifacial protrusion 5*d* causes the counterweight 54 to slide radially with the eccentric bushing 26. Thus, the amount of eccentricity and the orbiting radius of the movable scroll member 2 are reduced. Once the circular hole 54*b* of the counterweight 54 comes into contact with the outer peripheral surface 5*e* of the end portion of the boss portion 5*c*, however, the counterweight 54 is prevented from moving in radial direction. After that, therefore, the eccentric bushing 26 is rotated around the eccentric pin 5*b*, thereby additionally reducing the amount of eccentricity and the orbiting radius to zero.

As described above, as long as the position at which the counterweight 54 moves out of contact with the eccentric bushing 26 and comes into contact with the boss portion 5*c* of the shaft 5 substantially coincides with the position where the centrifugal force generated by the counter weight 54 is reduced below the centrifugal force generated by the movable scroll member 2, the intake pressure (negative pressure) is supplied to the control pressure chamber 10 by the control valve 11 as in the first embodiment. Thus, the head portion 8*a* of the plunger 8 is retreated from the guide hole 9, so that the resultant force of the centrifugal force acting on the movable scroll member 2 and the pressure generated in the compliance crankshaft mechanism 6 causes the operating condition at 100% capacity shown in FIG. 22 to be restored from the operating condition at 0% capacity shown in FIG. 25.

In this way, with the scroll-type compressor C10 according to the tenth embodiment, in the 100% capacity high-speed operating condition, the excessive pressure which otherwise might be exerted by the centrifugal force between the spiral blade 2*a* of the movable scroll member 2 and the spiral blade 3*a* of the stationary scroll member 3 is suppressed, thereby improving the reliability of the compressor.

Figure 26:
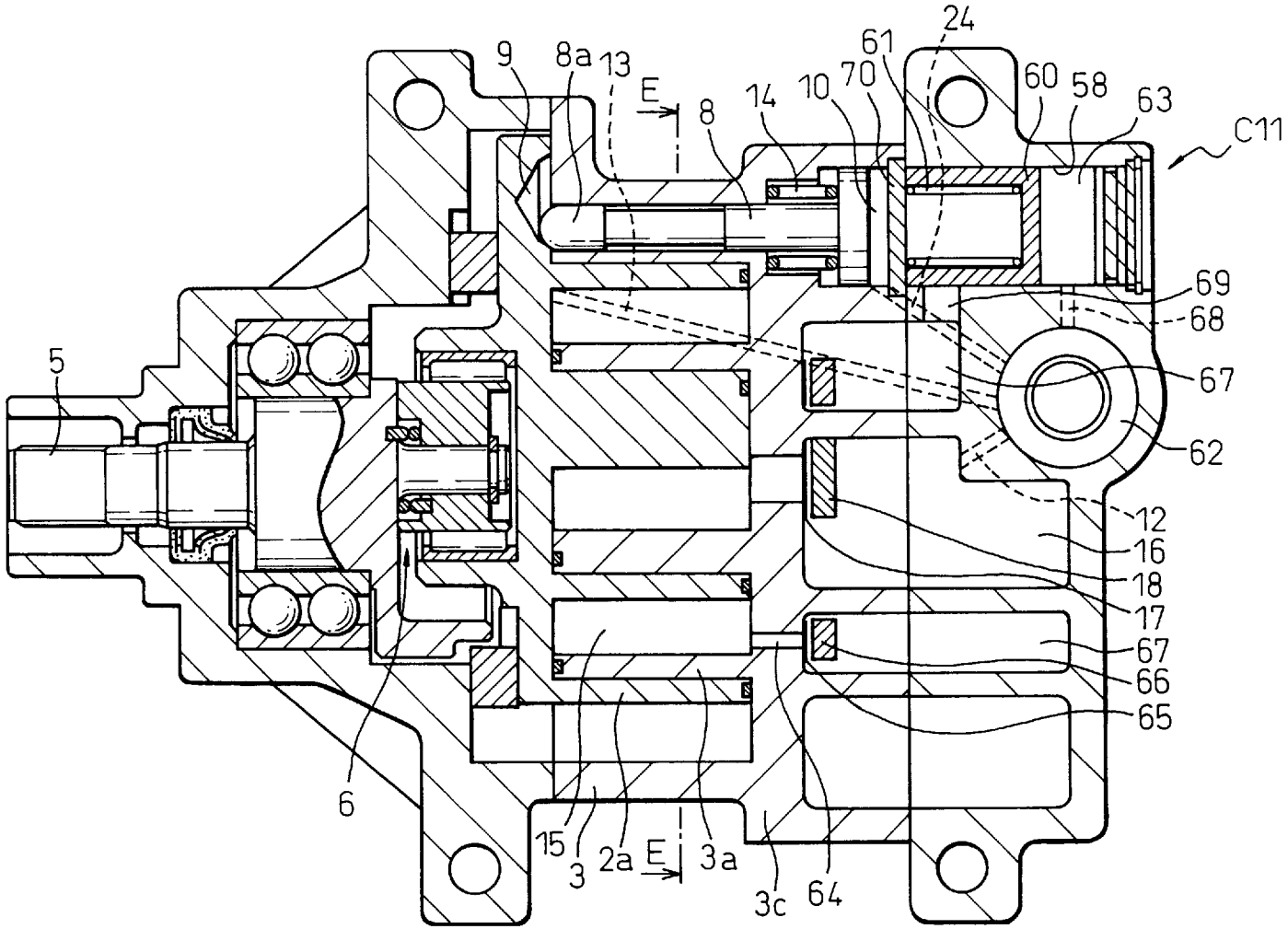
FIG. 26 is a longitudinal front view of a compressor operating at 100% capacity according to an 11th embodiment.
Figure 27:
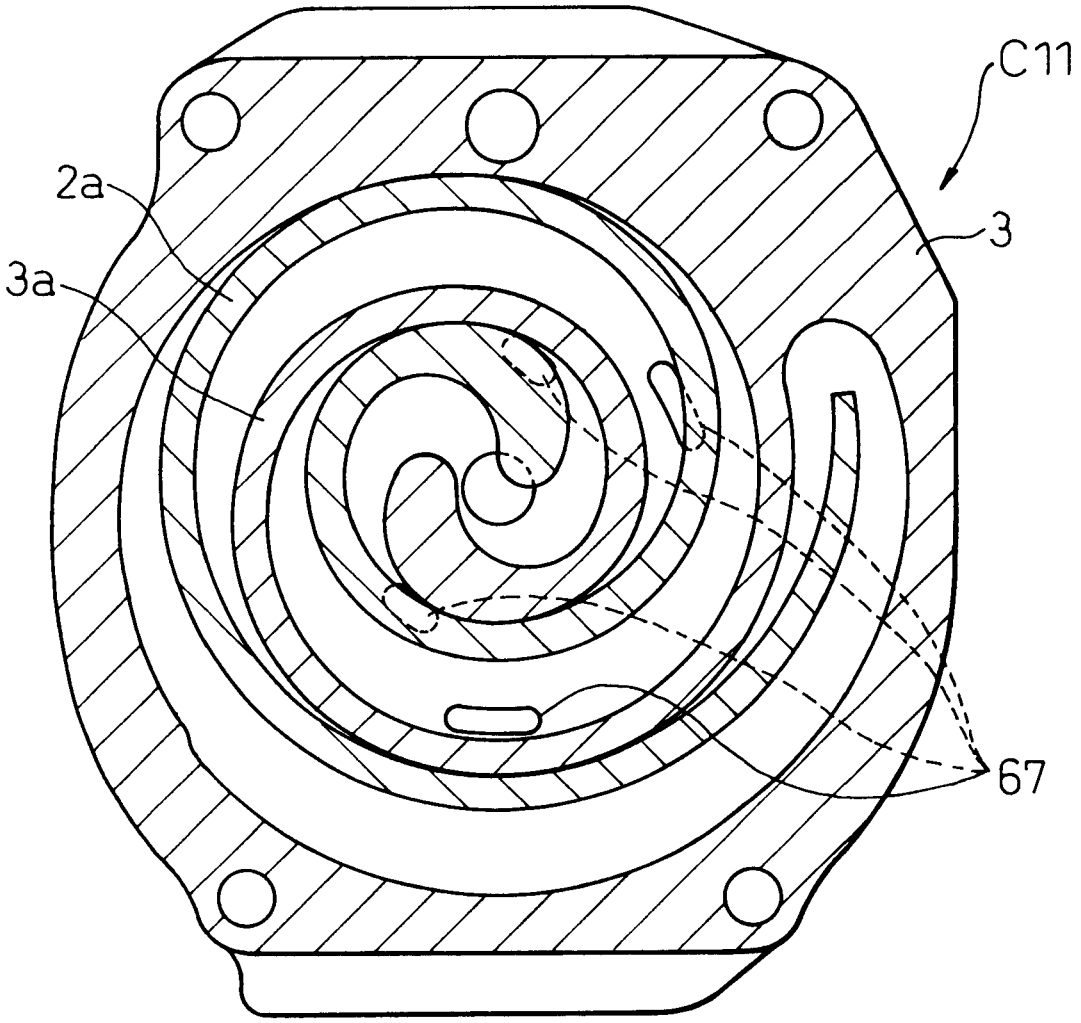
FIG. 27 is a cross side view taken in line E—E in FIG. 26, showing the essential parts of a compressor operating at 100% capacity according to the 11th embodiment.
Figure 28:
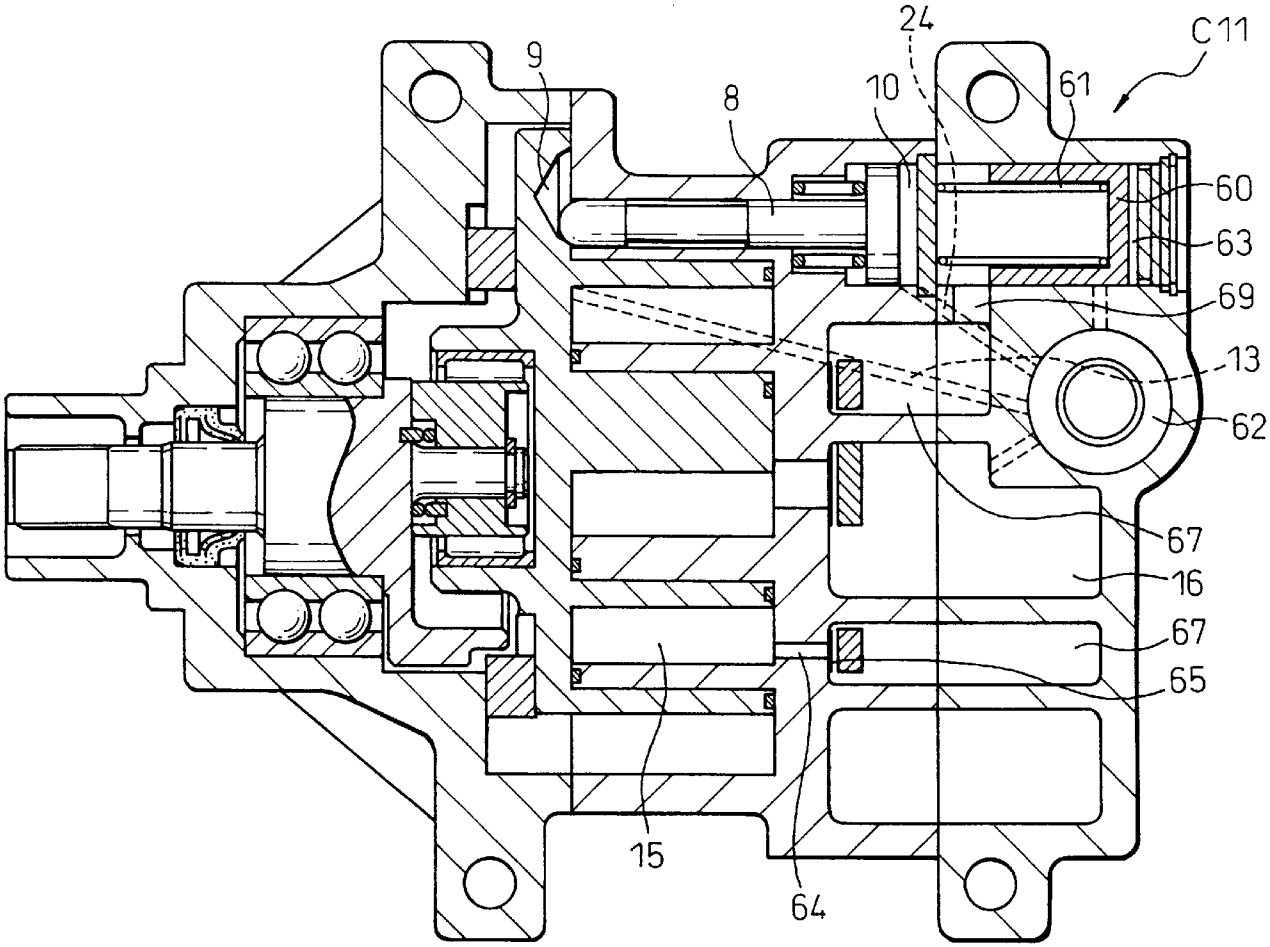
FIG. 28 is a longitudinal front view showing a compressor operating at intermediate capacity according to the 11th embodiment.

Finally, with reference to FIGS. 26 to 28, the scroll-type compressor C11 according to an 11th embodiment of the invention will be explained. In FIGS. 26 to 28, numeral 60 designates a spool inserted slidably into the cylinder 58 arranged in parallel to the axis of the shaft 5 in a part of the housing 4, and numeral 61 a spring for urging the spool 60 in such a direction as to contract the second control pressure chamber 63 behind the spool 60. Numeral 62 designates a control valve for producing a control pressure of the required magnitude from the discharge pressure (high-pressure) and the intake pressure (low-pressure like a weak negative pressure) of the compressor C11, and supplying it to the second control pressure chamber 63 for the spool 60 and the control pressure chamber 10 having a similar configuration to that of the first embodiment.

Numeral 64 designates a bypass hole open to an appropriate point of the end plate 3*c* of the stationary scroll member 3. The bypass hole 64 is provided with a check valve 65 with a protective valve stop plate 66 whereby the refrigerant contained in the compression chamber 15 at a pressure boosted to about an intermediate pressure between the discharge pressure and the intake pressure is released to the intermediate pressure chamber 67 of lower pressure, on the one hand, and the refrigerant is prevented from flowing in the opposite direction from the intermediate pressure chamber 67 to the compression chamber 15, on the other hand. Numeral 68 designates a control pressure path for leading the control pressure from the control valve 62 to the second control pressure chamber 63, and numeral 69 an intake pressure path for leading the intake pressure to the intermediate pressure chamber 67. The leftward movement of the spool 60 is blocked by a bar-shaped stopper 70. Thus, the spool 60 separates the control pressure chamber 10 and the second control pressure chamber 63 from each other. The spring 61 is also supported at the base end thereof by the stopper 70. The other configuration is substantially similar to that of the first embodiment shown in FIG. 1.

In the 100% capacity operation shown in FIG. 26, the control valve 62 is operated in such a manner that the control pressure chamber 10 assumes an intake pressure and the second control pressure chamber 63 assumes a discharge pressure. Thus, the head portion 8*a* of the plunger 8 is urged by the spring 14 rearward away from the guide hole 9. The spool 60 is in such a position as to close the intake pressure path 69 since a high pressure prevails in the control pressure chamber 63. As a result, the pressure in the intermediate pressure chamber 67 increases to such an extent that the check valve 65 is not opened. Thus, the movable scroll member 2 orbits with the maximum orbiting radius to enter the 100% capacity operation.

The transfer to the 0% capacity operation is carried out by supplying the discharge pressure to the control pressure chamber 10 from the control valve 62 substantially in the same manner as in the first embodiment. The feature of the 11th embodiment is that the operating condition for causing the intermediate discharge capacity between the 100% capacity and the 0% capacity can be maintained in stable fashion. For this purpose, the intake pressure (weak negative pressure) is imparted to the second control pressure chamber 63 by operating the control valve 62. As a result, the spool 60 is moved rearward under the force of the spring 61 and opens the intake pressure path 69. Thus, the intake pressure of the control pressure chamber 10 is introduced into the intermediate pressure chamber 67, which thus assumes an intake pressure. By doing so, the check valve 65 opens, so that the refrigerant of intermediate pressure that has thus far been contained in the compressor 15 is passed through a bypass hole 64 to the intake side, and therefore the discharge capacity is reduced to maintain the operation of intermediate capacity. In this way, the scroll-type compressor C11 according to the 11th embodiment can realize the operating condition of intermediate capacity as well as 100% and 0% capacity operations.

What is claimed is:

1. A scroll-type compressor comprising:

a housing journaling a drive shaft:

a stationary scroll member including an end plate fixed on said housing and a spiral blade around a center axis of said shaft;

a movable scroll member including an end plate and a spiral blade forming a plurality of compression chambers by engaging said spiral blade and said end plate of said stationary scroll member, said movable scroll member being capable of orbiting around the center axis of said shaft;

a compliance crankshaft mechanism interposed between said shaft and said movable scroll member for orbiting said movable scroll member by said shaft and allowing the orbiting radius of said movable scroll member to change steplessly downward substantially to zero;

a guide hole is formed at the end plate of said movable scroll member, wherein said guide hole has an axis and a conical surface, and wherein the axis of said guide hole is parallel to the center axis of said shaft;

a plunger is supported on said housing, wherein the plunger is adapted to advance toward and retract from said guide hole to assume a selected one of a position in engagement with said guide hole and a position out of engagement with said guide hole;

control operation means for controlling said plunger to advance and retract with respect to the direction of the center axis of said shaft; and urging means for retreating said plunger completely out of engagement with said guide hole.

2. A scroll-type compressor comprising:

a housing journaling a drive shaft;

a stationary scroll member including an end plate fixed on said housing and a spiral blade around a center axis of said shaft;

a movable scroll member including an end plate and a spiral blade forming a plurality of compression chambers by engaging said spiral blade and said end plate of said stationary scroll member, said movable scroll member being capable of orbiting around the center axis of said shaft;

a compliance crankshaft mechanism interposed between said shaft and said movable scroll member for orbiting said movable scroll member by said shaft and allowing the orbiting radius of said movable scroll member to change steplessly downward substantially to zero;

a guide hole is formed at the end plate of said movable scroll member, wherein said guide hole has an axis, which is parallel to the center axis of said shaft, and a two-stepped conical surface;

a plunger supported on said housing, wherein the plunger is adapted to advance toward and retract from said guide hole to assume a selected one of a position in engagement with said guide hole and a position out of engagement with said guide hole; and control operation means for controlling said plunger to advance and retract with respect to the direction of the center axis of said shaft.

3. A scroll-type compressor comprising:

a housing journaling a drive shaft;

a stationary scroll member including an end plate fixed on said housing and a spiral blade around a center axis of said shaft;

a movable scroll member including an end plate and a spiral blade forming a plurality of compression chambers by engaging said spiral blade and said end plate of said stationary scroll member, said movable scroll member being capable of orbiting around the center axis of said shaft;

a compliance crankshaft mechanism interposed between said shaft and said movable scroll member for orbiting said movable scroll member by said shaft and allowing the orbiting radius of said movable scroll member to change steplessly downward substantially to zero;

a guide hole formed in a selected one of said movable scroll member and said housing, wherein said guide hole has an axis and a conical surface, and wherein the axis of said guide hole is parallel to the center axis of said shaft;

a plunger movably supported on said housing, wherein the plunger is adapted to advance toward and retract from said guide hole to assume a selected one of a position in engagement with said guide hole and a position out of engagement with said guide hole, and wherein said guide hole is formed in said plunger;

control operation means for controlling said plunger to advance and retract with respect to the direction of the center axis of said shaft; and a pin formed on the end plate of said movable scroll member engages said guide hole.

4. A scroll-type compressor according to claim 3, wherein said guide hole has a substantially quadratic surface of revolution.

5. A scroll-type compressor according to claim 3, further comprising urging means for retreating said plunger completely out of engagement with said guide hole.

6. A scroll-type compressor according to claim 3, wherein a cylindrical surface is formed at the edge portion of the opening of said guide hole.

7. A scroll-type compressor according to claim 3, wherein said plunger is a single annular unit arranged around the center axis of said shaft.

8. A scroll-type compressor according to claim 3, wherein a counterweight is mounted movably in a radial direction on said shaft by a bifacial portion, and wherein said counterweight is moveable from a first position in contact with an outer periphery of an eccentric bushing constituting a part of said compliance crankshaft mechanism to a second position away from the outer periphery of said eccentric bushing by being brought into contact with an outer periphery of a large-diameter boss portion constituting a part of said shaft.

9. A scroll-type compressor according to claim 3, wherein said guide hole has a two-stepped conical surface.

10. A scroll-type compressor according to claim 3, wherein a bypass hole for establishing communication between a compression chamber of intermediate pressure under compression and a low-pressure side is opened to the end plate of said stationary scroll member, said compressor further comprising control means for controlling at least one of the opening and the closing of said bypass hole.

11. A scroll-type compressor comprising:

a housing journaling a drive shaft;

a stationary scroll member including an end plate fixed on said housing and a spiral blade around a center axis of said shaft;

a movable scroll member including an end plate and a spiral blade forming a plurality of compression chambers by engaging said spiral blade and said end plate of said stationary scroll member, said movable scroll member being capable of orbiting around the center axis of said shaft;

a compliance crankshaft mechanism interposed between said shaft and said movable scroll member for orbiting said movable scroll member by said shaft and allowing the orbiting radius of said movable scroll member to change steplessly downward substantially to zero;

a guide hole formed in a selected one of said movable scroll member and said housing, wherein said guide hole has an axis and a conical surface, wherein the axis of said guide hole is parallel to the center axis of said shaft, and wherein said guide hole is formed in an eccentric bushing constituting a part of said compliance crankshaft mechanism supporting the end plate of said movable scroll member;

a plunger supported on a selected one of said movable scroll member and said housing in which said guide hole is not formed, wherein the plunger is adapted to advance toward and retract from said guide hole to assume a selected one of a position in engagement with said guide hole and a position out of engagement with said guide hole, and wherein said plunger is supported on said shaft journaled by said housing; and control operation means for controlling said plunger to advance and retract with respect to the direction of the center axis of said shaft.

12. A scroll-type compressor according to claim 11, wherein said guide hole has a two-stepped conical surface.

13. A scroll-type compressor according to claim 11, wherein said guide hole has a substantially quadratic surface of revolution.

14. A scroll-type compressor according to claim 11, further comprising urging means for retreating said plunger completely out of engagement with said guide hole.

15. A scroll-type compressor according to claim 11, wherein a cylindrical surface is formed at the edge portion of the opening of said guide hole.

16. A scroll-type compressor according to claim 11, wherein said plunger is a single annular unit arranged around the center axis of said shaft.

17. A scroll-type compressor according to claim 11, wherein a counterweight is mounted movably in a radial direction on said shaft by a bifacial portion, and wherein said counterweight is moveable from a first position in contact with an outer periphery of an eccentric bushing constituting a part of said compliance crankshaft mechanism to a second position away from the outer periphery of said eccentric bushing by being brought into contact with an outer periphery of a large-diameter boss portion constituting a part of said shaft.

18. A scroll-type compressor according to claim 11, wherein a bypass hole for establishing communication between a compression chamber of intermediate pressure under compression and a low-pressure side is opened to the end plate of said stationary scroll member, said compressor further comprising control means for controlling at least one of the opening and the closing of said bypass hole.

19. A scroll-type compressor comprising:

a housing journaling a drive shaft;

a stationary scroll member including an end plate fixed on said housing and a spiral blade around a center axis of said shaft;

a movable scroll member including an end plate and a spiral blade forming a plurality of compression chambers by engaging said spiral blade and said end plate of said stationary scroll member, said movable scroll member being capable of orbiting around the center axis of said shaft;

a compliance crankshaft mechanism interposed between said shaft and said movable scroll member for orbiting said movable scroll member by said shaft and allowing the orbiting radius of said movable scroll member to change steplessly downward substantially to zero;

a guide hole is formed at the end plate of said movable scroll member, wherein said guide hole has an axis and a conical surface, and wherein the axis of said guide hole is parallel to the center axis of said shaft;

a plunger is supported on said housing, wherein the plunger is adapted to advance toward and retract from said guide hole to assume a selected one of a position in engagement with said guide hole and a position out of engagement with said guide hole; and control operation means for controlling said plunger to advance and retract with respect to the direction of the center axis of said shaft, wherein:

a counter weight is mounted movably in a radial direction on said shaft by a bifacial portion, and said counterweight is movable from a first position in contact with the outer periphery of the eccentric bushing constituting a part of said compliance crankshaft mechanism comes to a second position away from the outer periphery of said eccentric bushing by being brought into contact with the outer periphery of a large-diameter boss portion constituting a part of said shaft.

20. A scroll-type compressor comprising:

a housing journaling a drive shaft;

a stationary scroll member including an end plate fixed on said housing and a spiral blade around a center axis of said shaft;

a movable scroll member including an end plate and a spiral blade forming a plurality of compression chambers by engaging said spiral blade and said end plate of said stationary scroll member, said movable scroll member being capable of orbiting around the center axis of said shaft;

a compliance crankshaft mechanism interposed between said shaft and said movable scroll member for orbiting said movable scroll member by said shaft and allowing the orbiting radius of said movable scroll member to change steplessly downward substantially to zero;

a guide hole is formed at the end plate of said movable scroll member, wherein said guide hole has an axis and a conical surface, and wherein the axis of said guide hole is parallel to the center axis of said shaft;

a plunger is supported on said housing, wherein the plunger is adapted to advance toward and retract from said guide hole to assume a selected one of a position in engagement with said guide hole and a position out of engagement with said guide hole;

control operation means for controlling said plunger to advance and retract with respect to the direction of the center axis of said shaft;

a bypass hole for establishing communication between a compression chamber of intermediate pressure under compression and a low-pressure side, wherein the bypass hole is opened to the end plate of said stationary scroll member, and;

control means for controlling at least one of the opening and the closing of said bypass hole.

* * * * *